United States Patent [19]

Cox

[11] 3,938,434

[45] Feb. 17, 1976

[54] SLUDGE DEWATERING

[76] Inventor: Clyde H. Cox, 12723 Gaylawood Drive, Houston, Tex. 77066

[22] Filed: June 10, 1974

[21] Appl. No.: 477,797

Related U.S. Application Data

[63] Continuation-in-part of Ser. No. 342,772, March 19, 1973, abandoned.

[52] U.S. Cl. ..... 100/117; 100/90; 100/112; 100/145; 210/225

[51] Int. Cl.[2] ..... B30B 9/14

[58] Field of Search ..... 100/110–117; 210/225, 298, 414, 415

[56] References Cited

UNITED STATES PATENTS

| | | | |
|---|---|---|---|
| 643,891 | 2/1900 | Bussells | 100/117 X |
| 793,267 | 6/1905 | Barth | 100/117 UX |
| 808,193 | 12/1905 | Bussells | 100/117 X |
| 1,333,249 | 3/1920 | Fiddyment | 100/117 |
| 1,876,064 | 9/1932 | Lang | 100/112 |
| 2,355,091 | 8/1944 | McDonald | 100/145 X |
| 2,436,064 | 2/1948 | Crosby | 100/117 X |
| 3,126,818 | 3/1964 | Koelsch | 100/112 |
| 3,188,942 | 6/1965 | Wandel | 100/112 |
| 3,695,173 | 10/1972 | Cox | 100/112 |

*Primary Examiner*—Peter Feldman
*Attorney, Agent, or Firm*—Owen, Wickersham & Erickson

[57] ABSTRACT

A filter-dewatering-expression apparatus. Rotating helical blades of a screw conveyor compress and squeeze liquid from the sludge within structure which permits the liquid to escape therefrom, and discharge the dewatered solids out the end. The filter-dewatering medium which is held rigid by a frame may be a series of hoops or rings, separated and closely spaced, or may be a continuous wire, semicircular in cross section, closely wound into a coil, or may be a perforated screen. An imperforate filtrate collection housing surrounds this medium, and a vacuum pump is connected to the filtrate housing. A coil-spring wiping or cleaning blade may be held on the outside edge of the helical blade of the screw conveyor for continuous contact with the inside surface of the filter-dewatering medium, cleaning solids therefrom. Cleaning nozzles project out radially from the outer edge of the helical blades of the screw conveyor, spaced to discharge under pressure, a forceful blast of the air or other gas, steam, or water into the open area of the medium, to positively dislodge material therein and keep the medium unplugged, non-blinded, clean, and open. Air or steam may be added to the sludge within the structure by ports located in the screw conveyor shaft. A removable spiral shaft wrap may be rotated over and wound around, covering the screw conveyor shaft within the structure, threading the helical blade, to vary the inside configuration of the dewatering press. A plural-section screw conveyor may be utilized within the press, each section being capable of being rotated at different speeds of rotation.

48 Claims, 37 Drawing Figures

SLUDGE DEWATERING

REFERENCE TO RELATED APPLICATION

This application is a continuation-in-part of application Ser. No. 342,772, filed Mar. 19, 1973, now abandoned.

BACKGROUND OF THE INVENTION

This invention relates to filtration and dewatering of sludge and other slurry. Particularly it relates to an apparatus employing continuous filter-dewatering-expression under vacuum-compression.

Sludge may be defined as a semiliquid deposit or sediment having a total solids concentration of at least 2500 ppm.

Sludge handling and disposal is the most troublesome aspect of wastewater treatment, and it is often the most costly. The problem is increased with efficient wastewater treatment plants being built and operated today producing higher fractions of the waste impurities in the form of sludges than formerly were possible. Also, in advanced wastewater treatment, the use of chemicals produces great quantities of sludge, further complicating the sludge handling and disposal problem.

One step in sludge handling and disposal involves filtration or dewatering, to reduce the sludge moisture content, generally to a non-fluid form, to a degree which allows ultimate disposal by incineration, landfilling, or other methods. Heretofore, sludge filter-dewatering has been attempted principally by open-air bed drying, vacuum filtration, centrifugation, and mechanical separation. A brief comment on each of these techniques may be helpful to an understanding of the purpose and achievements of the present invention.

Open-air drying beds have become less and less attractive, due to reduced land availability and the lessening of public tolerance for techniques open to the atomsphere with the possibility of air pollution.

Vacuum filtration separates the insoluble solids from the liquid by using differential pressures created by a vacuum pump, to force the liquid through a porous medium carried on a rotating drum, on which the solids remain to form a cake. The filter medium, which requires replacement periodically, requires a substantial flow of washwater to prevent plugging or blinding of the open area. The vacuum filter involves large equipment, many moving parts, high operating horsepower, and is expensive to purchase, operate and to maintain.

Centrifuges require high speeds of revolution, typically ranging from approximately 2000 rpm to 4500 rpm. The insoluble solids of the feed slurry or sludge centrifugally settle against the bowl wall, and the liquid flows toward and out a central discharge. The solids are typically pushed out through discharge ports and collected from the bowl. The centrifuge cannot tolerate grit without excessive wear and requires large operating horsepower. They are expensive to purchase, to operate, and to maintain.

Mechanical separation has typically been sought by plate and frame filters, typically comprising an alternating series of empty rings that serve to contain the final filter cake. The plates are covered on both sides with cloth and are provided with drainage channels for removal of the filtrate. The frames are filled with a batch of slurry under pressure, and the filtrate escapes through the cloth and through the plate channels, while the frames are left filled with filter cake. At the end of each cycle, the press is opened and the cake is removed for further treatment or disposal. This is an intermittent or batch type of operation and therefore is associated with the high labor costs resulting from manual operation, so that the plate and frame filters are expensive to operate and very expensive also in first or capital costs.

A typical dewatering screw press of the prior art comprised a rotating screw fitting closely inside a horizontal slotted or perforated curb. The curb and screw were typically tapered toward the discharge end, in order to increase the pressure on the material being dewatered. The discharge end was partially closed by an adjustable cone to vary the discharge opening and thus to vary the pressure on the material within the dewatering press. Rotation of the screw conveyed the material toward the discharge end, and as the pressure increased, the liquid associated with the material was forced out through the slots or perforations in the curb. However, it has been found that the dewatering press of the prior art will not perform satisfactorily on sewage sludges, due to the plugging and blinding of the slots or perforations of the filter-dewatering medium or curb, by the small and stringy solids contained in sewage sludge. The prior art did not provide an effective method or apparatus for cleaning the slots or perforations without interrupting continuous dewatering. Also, the prior art of the dewatering press did not provide for a reduction of the initial or design open area or the perforations or slots in the curb without a complete change of the curb itself.

My earlier U.S. Pat. No. 3,695,173, issued on Oct. 3, 1972, provides an improved apparatus for filtration-dewatering of sludge continuously. It has a permanent filter-dewatering medium comprising a series of hoops or rings separated and closely spaced from each other and held together as a single unit by a frame, and apparatus for continuously cleaning the filter-dewatering medium while filtering or dewatering. To prevent plugging or blinding and interruption of continuous filtration or dewatering, cutter or slot cleaning blades are secured to the outer edge of the screw conveyor, projecting out radially and spaced to extend into the slots or spaces between the closely spaced filter rings or hoops. The fine solids which have entered and become wedged in the spaces between the filter rings tending to plug or blind the open area of the filter-dewatering medium and the small stringy portions of large solids which have entered the spaces between the filter rings, but cannot pass through and out due to the large portions of the solids being retained on the surface of the filter-dewatering medium, are dislodged and pass through and out with the filtrate with the cutting or cleaning action of the cutter or slot-cleaning blades, when the rotating helical blade of the screw conveyor along with the conveyed sludge or dewatered solids, cuts and scrapes away the solids retained on the filter-dewatering medium.

U.S. Pat. No. 3,695,173 also provides apparatus to decrease the initial or design open area of the filter-dewatering medium to prevent undue bleeding of the solids into the filtrate by the utilization of slot-reducing or space-bridging members or material which bridge or partially close or effectively reduce the open area or spaces between the closely spaced filter rings of the filter-dewatering medium when the sludge nature and consistency warrants.

An important object of this invention is to provide a greatly improved apparatus for filter-dewatering-expression of sewage sludge or other slurries. One aspect is directed to improved apparatus for preventing plugging and blinding of the filter-dewatering medium and interruption of the continuous filtration, dewatering, and expression.

A characteristic of the prior art dewatering screw presses was to employ an adjustable choke or cone at the discharge end of the press to vary the discharge opening and control the back pressure within the pressing chamber. It has been found, however, that for dewatering sewage sludge, the adjustable choke or cone at the discharge end of the dewatering press, by itself, will not provide for sufficient variation in back pressure within the press. U.S. Pat. No. 3,518,936 issued to Bredeson provides for adjustably controlling the backup pressure within the press at one or more points intermediate the inlet and discharge ends of the press with annular choke members. However, it has been found that while the intermediate choke does increase pressure upon the material at the point of application of the choke, after the material has been conveyed past the choke, the pressure will be reduced. Due to the large variation in the nature and consistency possible with sewage sludge, this cyclic increase and decrease in pressure upon the sludge has been ineffective in adjusting the back pressure within the press. The prior art does not provide for varying the inside configuration of the dewatering press to a great extent, decreasing the dewatering and compression volume within the press, nor changing the dewatering and compression rate within different portions of the press.

The present invention has the further object, therefore, of providing an apparatus for increasing the diameter of the combination sludge compression and dewatered solids discharge screw conveyor shaft, varying the inside configuration of the dewatering press, decreasing the compression volume within the press, changing the compression and dewatering rate within different portions of the dewatering press, and at the same time, decreasing the dewatered solids outlet, thereby varying the quantity and dryness of the dewatered solids discharged from the press.

A further object of this invention is to provide for regulating the quantity and dryness of the dewatered solids discharged from the press.

Other objects and advantages of this invention will be apparent from the ensuing disclosure and appended claims.

SUMMARY OF THE INVENTION

This invention provides a filter-dewatering-expression apparatus for dewatering sewage sludge and other slurries, and for dewatering-expression of filter or centrifuge cake resulting from conventional vacuum filters or centrifuges when a more thorough removal of liquid from the cake is desired.

The apparatus of this invention comprises a flow-impeding structure and a combination sludge compression and dewatered solids discharge screw conveyor. The flow-impeding structure preferably consists of an initial cylindrical portion, a following frustoconical portion, and a terminal cylindrical portion and is the filter-dewatering medium. It comprises either: a series of hoops or rings separated and closely spaced, held rigid by a frame; a continuous wire, semicircular in cross section, closely wound into a coil, held rigid by a frame; or a perforated screen held rigid by a frame. The rotating helical blades of the screw conveyor compress and squeeze liquid from the sludge within the structure through which the liquid escapes, and the screw conveyor discharges the dewatered solids out the end. An imperforate filtrate or liquid collection housing surrounds the structure, and a vacuum pump is connected to the filtrate housing. One end of the screw conveyor shaft is supported for rotation within the structure at the input end and the other end of the shaft protrudes the discharge end and is connected to a suitable source of power.

An important feature of the present invention is that a coil-spring wiping or cleaning blade is positioned on the outside edge of the screw conveyor helical blade to provide continuous contact between the wiping or cleaning blade and the inside surface of the filtering-dewatering medium. The spring action or tendency of the coil-spring blade to expand enables improved wiping action and cleaning of the solids from the inner surface of the medium.

Another significant feature of the invention is a series of cleaning nozzles that project out radially from the outer edge of the helical blades of the screw conveyor and are spaced to discharge, under pressure, a forceful blast of the air or other gas, steam, or water into the open area of the filter-dewatering medium to positively dislodge material therein and keep the filter-dewatering medium unplugged, non-blinded, clean, and open.

Air or steam may be added to the sludge within the structure, while it is operating, by ports located in the screw conveyor shaft.

A removable spiral shaft wrap may be rotated over and wound around, covering the screw conveyor shaft within the structure, threading the spiral-helical blade, to vary the inside configuration of the dewatering press so that the quantity and dryness of the dewatered solids discharged out the end can be varied.

A plural-section sludge compression and dewatered solids discharge screw conveyor may be utilized. Each section is capable of being rotated at different speeds of rotation to regulate the detention time of the sludge within the different portions of the structure, changing the dewatering and compression rate within the different portions of the dewatering press, therefore controlling the quantity and dryness of the dewatered solids discharged out the end. In one case, the helical blade section in the frustoconical and the terminal cylindrical portions of the structure is a continuous helical blade and is mounted on a covering shaft which slips over and is concentric to the central shaft of the two section screw conveyor. The helical blade section in the initial cylindrical portion is mounted on the central shaft of the screw conveyor. Both sections are of the same "hand" and may rotate in the same direction and at different speeds of rotation. Both shafts may be driven from the same end.

Cutter or annular slot-cleaning blades may be utilized with the filter-dewatering medium cleaning nozzles to assist in keeping the filter-dewatering medium clean and open, or they may be utilized separately.

DESCRIPTION OF PREFERRED EMBODIMENTS

Figure 1:
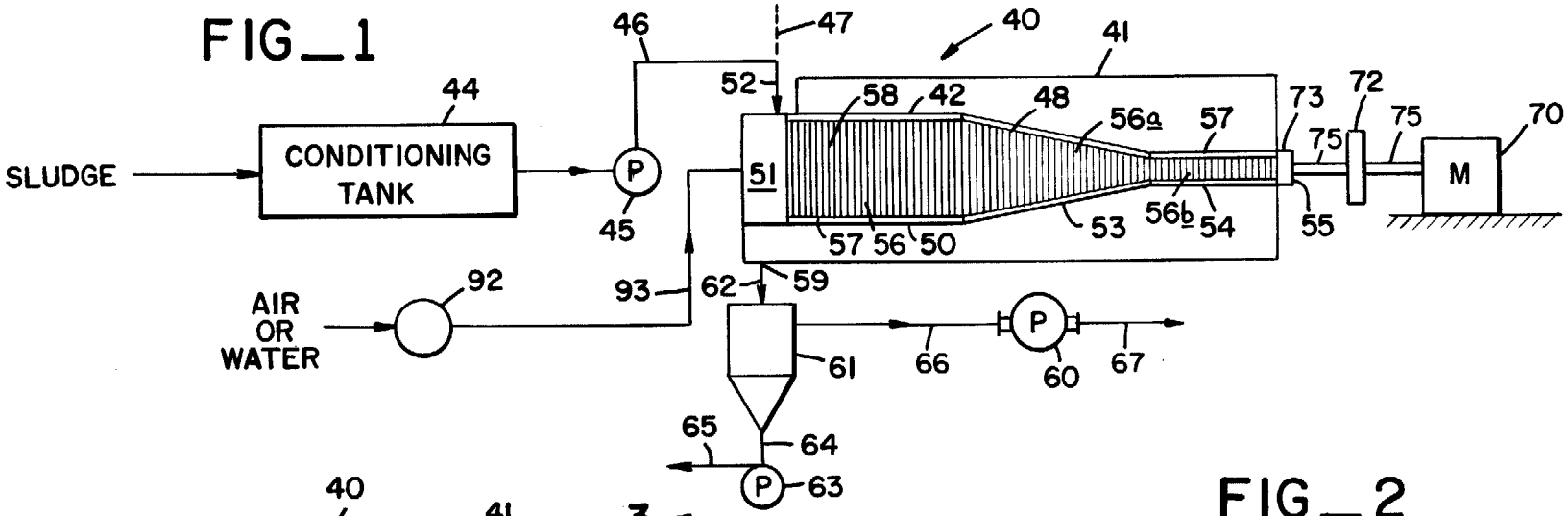
FIG. 1 is a schematic flow diagram, only partly representational, of a sludge-dewatering system embodying the principles of the invention.

THE GENERAL SYSTEM (FIG. 1):

FIG. 1 shows a general system embodying the principles of the invention.

The system comprises a filter-dewatering-expression press 40 having a generally imperforate filtrate or liquid collection housing 41, a filter-dewatering structure 42, and a combination sludge compression and dewatered solids discharge screw conveyor 43.

When the press 40 is used to process sludge, it may be connected to a sludge conditioning tank 44. The conditioning of slugde in tank 44 may be, for example, by chemical treatment, by polyelectrolyte addition, by heat conditioning, or by freezing. The conditioned sludge may flow under pressure via a variable speed pump 45 and a conduit 46, or may flow by gravity in the conduit 46 to the press 40.

When the press 40 is utilized for dewatering-expression of conventional vacuum filter or centrifuge cake, to achieve a more thorough removal of liquid from the cake, the sludge may be introduced to the press 40 via a screw conveyor feed system 47 (shown dotted) in lieu of the pump 45 and the conduit 46.

The filter-dewatering structure 42 of the press 40 has a filter-dewatering medium 48 and preferably comprises an initial cylindrical portion 50, which includes a sludge input end 51 and an inlet connection 52. The sludge input end 51 preferably has a removable end plate 251 to enable insertion of the screw conveyor 43 into and removal from the filter-dewatering structure 42. The sludge input end 41 may be machined to provide a recessed surface 252 for receiving and positioning the removable end plate 251 and may be locked in position by locking plates 253 and screws 254.

The cylindrical portion 50 is followed by a frustoconical portion 53, which in turn is followed by a smaller diameter terminal cylindrical portion 54, which includes a dewatered solids output opening 55. The filter-dewatering structure 42 disclosed in my earlier U.S. Pat. No. 3,695,173 may be used, wherein the filter-dewatering medium 48 comprises a series of hoops or rings 56, 56*a*, and 56*b* that are separated and closely spaced from each other and are held rigidly together as a single unit (as by heli-arc welds) to a reinforcing frame 57. Annular spaces 58 between the filter-dewatering rings 56, 56*a*, 56*b* provide escape passages through which liquid or filtrate can be forced but are not wide enough to permit escape of the solids. The filter-dewatering hoops or rings 56, 56*a*, 56*b* may be various widths and may be held apart at various spaces 58 of separation, to provide various open areas.

The imperforate filtrate or liquid collection housing 41 surrounds the structure 42 and collects the filtrate or liquid that was associated with the sludge and has a liquid or filtrate outlet 59.

A vacuum pump 60 and a gas-liquid separator 61 are connected to the imperforate outer housing 41 by a conduit 62. Both air and filtrate enter the separator 61, which may be any of well-known apparatus to separate the air or other gas from the liquid. The filtrate or liquid enters a filtrate pump 63 via a conduit 64 and is pumped away through a conduit 65, while the air or other gas enters the vacuum pump 60 via a conduit 66 and is exhausted away through a discharge conduit 67.

A motor 70 turns a shaft 75 of the conveyor 43. For initial startup of the filter-dewatering press 40, a startup cap 72 is preferably utilized to plug temporarily the normally open dewatered solids output opening 55 of the terminal cylindrical portion 54 of the structure 42. The startup cap 72 is then screwed into position on a threaded sleeve 73, which is attached to the dewatered solids output opening 55. After dewatered solids accumulate sufficiently in the frustoconical portion 53 and the terminal cylindrical portion 54, the startup cap 72 is removed, to permit discharge of the dewatered solids by the rotating screw conveyor 43. Usually for initial startup, this takes only a few seconds.

Inlet pressure, when the pump 45 is utilized, raises the feed sludge above atmospheric, and along with the squeezing and pressing of the sludge which results during the conveyance and compression of the sludge through the filter-dewatering structure 42, a differential pressure is established between the sludge or other slurry within the structure 42 at a higher than atmospheric pressure and the filtrate collected from outside the structure 42 at less than atmospheric pressure, created by the vacuum pump 60. Filtrate or liquid associated with the sludge is forced or expelled through the open area defined by the annular spaces 58 between the filter-dewatering hoops or rings 56, 56*a*, 56*b* of the structure 42, and is collected outside the structure 42 by the filtrate housing 41. The solids are deposited or retained on the inner surface of the structure 42, and are conveyed through the structure 42 for further compression and dewatering, and they pass relatively dry out the dewatered solids output opening 55, conveyed by the sludge compression and dewatered solids discharge screw conveyor 43.

This is the general system. Certain problems arise when practicing it that are solved by the present invention. The problems and the solutions will be better understood by considering the press 40 in more detail.

Figure 2:
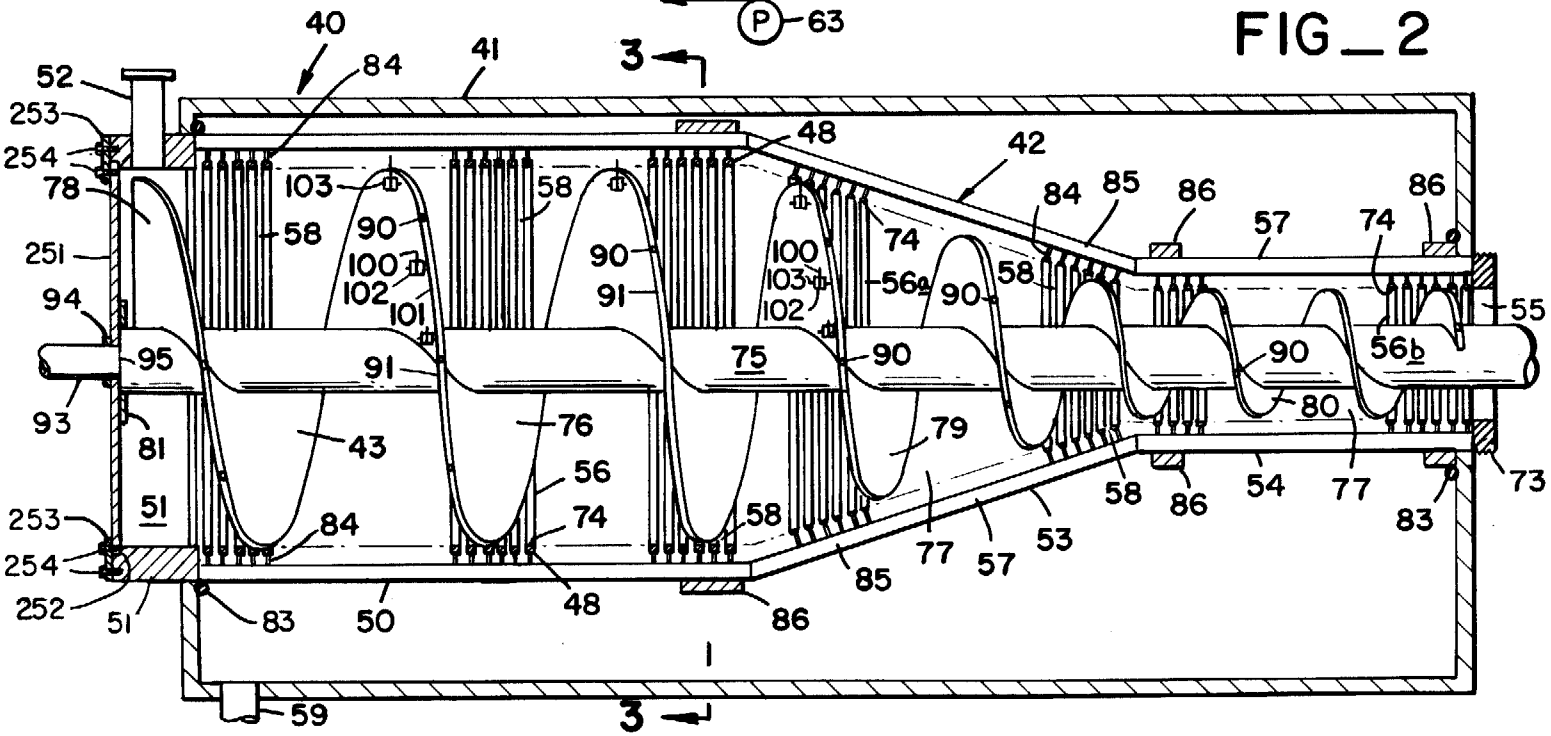
FIG. 2 is a side elevational view, partially in section, of a filter-dewatering-expression press of this invention. It is on an enlarged scale with respect to FIG. 1.
Figure 3:
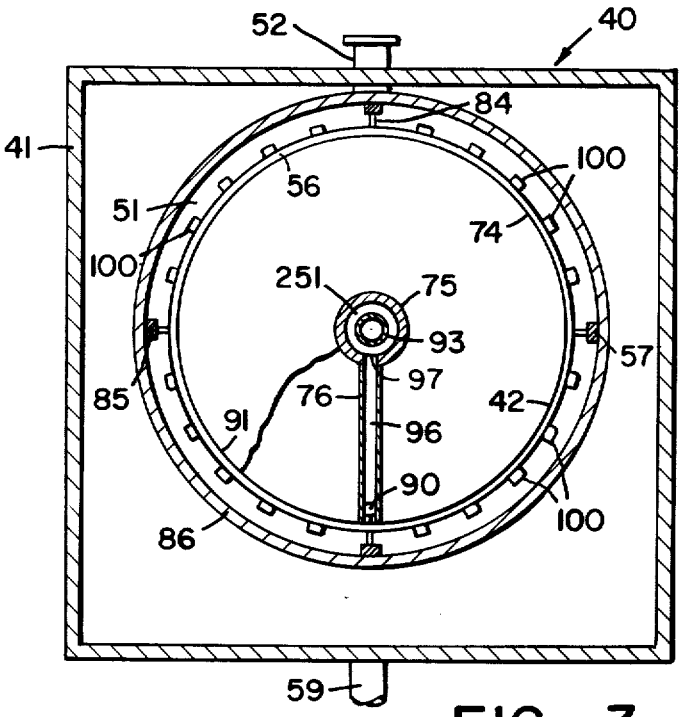
FIG. 3 is a sectional view taken along the line 3—3 in FIG. 2.

A SPECIFIC PRESS 40 IN MORE DETAIL (FIGS. 2–6 AND 33–37):

FIGS. 2 and 3 show the filter-dewatering press 40 in more detail and show the conveyor 43 in detail also.

The inner surface 74 of the filter-dewatering medium 48 is finished smooth as by grinding, to provide a flat or uniform dewatering and conveying surface. As one example, I have found that filter-dewatering hoops or rings 56 having a width of 0.250 inch and having a space 58 of separation of 0.008 inch with a 0.250 inch wall thickness can be readily fabricated and assembled, and gives optimum open area of the filter-dewatering medium 48, for an excellent dewatered sewage solids production rate, with low solids in the filtrate, at low chemicals, for conditioning. The hoops or rings 56, 56*a*, 56*b* may be alloy steel or plastic.

Figure 4:
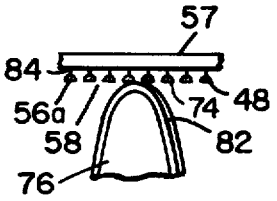
FIG. 4 is a fragmentary sectional view of FIG. 2, showing a wearable replaceable leading edge or strip on the combination sludge compression and dewatered solids discharge screw conveyor.

The combination sludge compression and dewatered solids discharge screw conveyor 43 comprises a constant diameter central shaft 75 along its axis on which is mounted a spiral-helical blade or flight 76, conforming closely to the inner surface 74, of the filter-dewatering structure 42, providing a spiral-helical space or extrusion channel 77 defined by the space between the central shaft 75 and the inner surface 74 of the filter-dewatering structure 42 extending from the sludge input end 51 to the dewatered solids output opening 55. The blade or flight 76 may be of constant pitch or may have a variable pitch, as shown in FIG. 2, includes a feed portion 78, disposed within the sludge input end 51, a compression portion 79, and a dewatered solids discharge portion 80. The blade or flight 76 is continuous, or if desired, may be an interrupted helical or spiral flight arrangement. The screw conveyor shaft 75 is supported for rotation within the structure 42 at the sludge input end 51, by means of a shaft bearing and seal 81 attached to the removable end plate 251, or if desired, may be supported outside the input end 51 for rotation. The other end of the screw conveyor shaft 75 protrudes the dewatered solids output opening 55 and is connected to a suitable source of power, such as a variable speed reversing drive assembly 70. A wearable replaceable leading edge or strip 82, such as Teflon, rubber, or plasticized polyvinyl chloride material, may be provided and attached to the screw conveyor blade or flight 76 as shown in FIG. 4. However, the structure of FIGS. 33–37 is preferred.

The filtrate collection housing 41 is sealed to the filter-dewatering structure 42 by seals 83 at the initial cylindrical portion 50 and at the terminal cylindrical portion 54.

The filter-dewatering structure 42 may have its rings 56, 56*a*, and 56*b* secured rigidly to the frame 57 by heli-arc welds 84 (FIGS. 2–4), and the frame 57 may comprise a longitudinally extending series of support rods 85 with circular holding bands 86.

As an example of relative sizes, the following is given for a filter-dewatering-expression press 40 for dewatering sewage sludge:

| | |
|---|---|
| Sludge input end inside diameter | 10" |
| Dewatered solids output opening inside diameter | 4" |
| Central shaft outside diameter | 2" |
| Helical blade or flight pitch | 4" |
| Filter-dewatering ring width | 0.250" |
| Annular spaces between rings | 0.008" |
| Length of initial cylindrical portion | 36" |
| Length of frustoconical portion | 24" |
| Length of terminal cylindrical portion | 14" |

With the structure so far described there is a problem of plugging or blinding of the open area of the filter-dewatering press 40 or the annular spaces 58 between the filter-dewatering hoops or rings 56, 56*a*, 56*b* of the filter-dewatering structure 42, and interruption of continuous filtration-dewatering.

The present invention solves this problem, preferably by providing, as shown in FIGS. 33–37, a coil-spring wiping or cleaning blade 87. This blade 87 may be positioned on the outside edge of the blade 76 by a series of guides 88. There is continuous contact between the coil-spring blade 87 and the inside surface 74 of the filtering dewatering medium 48, due to the spring action or the expansion tendency of the blade 87. This continuous contact causes the wiping and thus the cleaning of solids from the inner surface 74.

The coil-spring wiping or cleaning blade 87 may be fabricated in any suitable manner or may be coiled from pieces of various dimensions. However, I have found that steel rod of rectangular cross section 0.041 inches × 0.153 inches, coiled and then heat treated to provide a coil having an inside diameter slightly larger than the diameter of the screw conveyor blade 76 and having a pitch equal to the pitch of the screw conveyor 43, provides good contact for continuous wiping or cleaning without excessive pressure and without excessive wear of the inside surface 74 of the medium 48. The blade 87 may be a continuous helical coil or blade which extends along the entire radially outer edge of the spiral helical blade 76; one end of such a coil-spring blade 87 may be attached rigidly to the blade 76. Alternatively, there may be a series of shorter blades 87, each one following another, with one end of each attached rigidly to the blade 76. Rigid attachment at only one end enables the blade or blades 87 to be compressed, so that the screw conveyor 43 can be inserted with the blade 87 into the filter-dewatering structure 42; after insertion, the blade 87 tends to expand, due to its spring action, and provides the desired continuous contact with the surface 74, giving effective cleaning of the solids from the surface 74.

Figure 33:
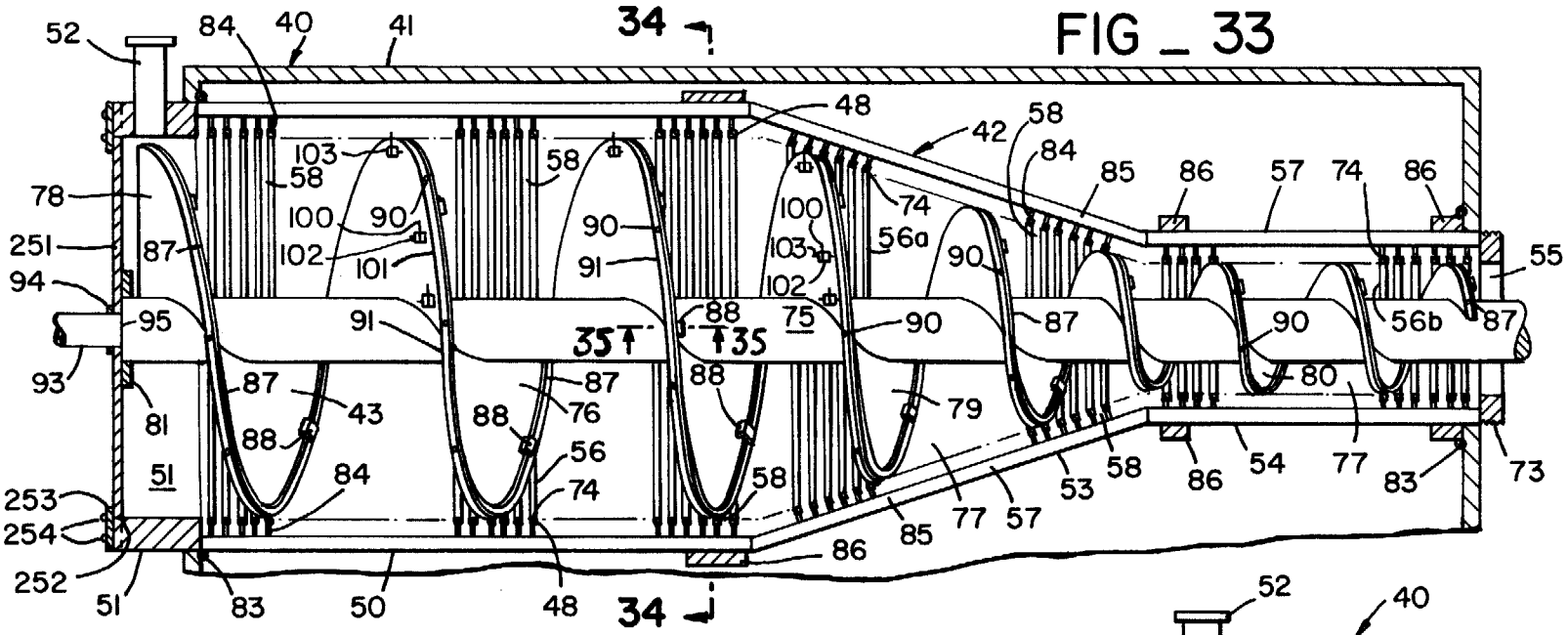
FIG. 33 is a view similar to FIG. 2 wherein a coil-spring wiping or cleaning blade is provided along the outside edge of the screw conveyor.
Figure 34:
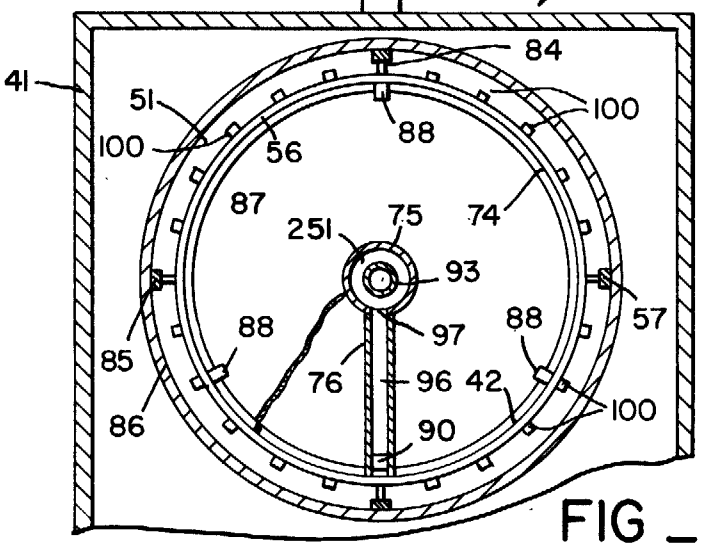
FIG. 34 is a view taken along the line 34—34 in FIG. 33.
Figure 35:
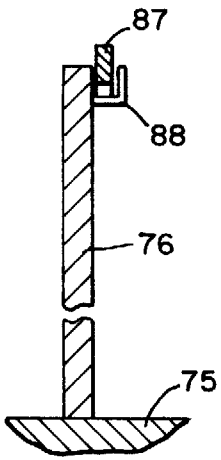
FIG. 35 is a fragmentary sectional view taken along the line 35—35 in FIG. 33.

As shown in FIGS. 33, 34 and 35, the blade 87 may be positioned by the short guide clips 88, which are attached to the screw conveyor flight 76 and allow compression and expansion of the blade 87. As the blade 87 wears, its spring action continues to assure good contact with the surface 74 and therefore good cleaning as the screw conveyor 43 rotates.

Figure 36:
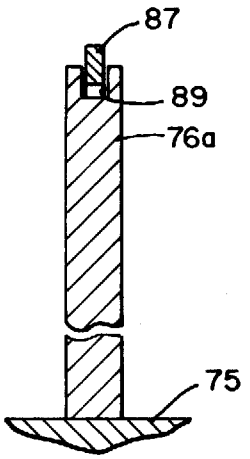
FIG. 36 is a view similar to FIG. 35 of a modified form of support for the coil-spring blade.

FIG. 36 shows an alternative structure, in which the blade 87 is positioned with a groove 89 of a helical blade 76*a*.

Figure 37:
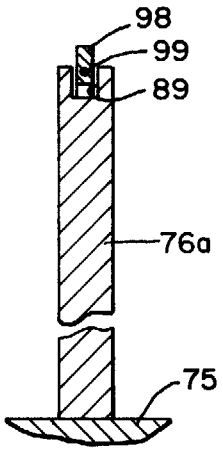
FIG. 37 is another view similar to FIG. 35 of another modified form of support and a modified type of coil-spring blade.

FIG. 37 shows an alternative spring blade structure. Here, a rubber or plasticized polyvinyl chloride or other plastic blade 98 contains a coil spring 99. The spring 99 provides the spring action or tendency to expand, while the plastic blade 98 does the actual wiping of the surface 74.

To assist in the cleaning of the annular spaces 58 between the filtering-dewatering rings 56, 56*a* and 56*b*, cleaning nozzles 90 may be utilized. These nozzles 90 may be an integral part of, or attached to the outer edge 91 of the helical blade or flight 76, projecting out radially and spaced apart. The nozzles 90 discharge, under pressure, a forceful blast of fluid (air or other gas, steam, or water) into the annular spaces 58 between the filter-dewatering rings 56, 56*a*, 56*b* to positively dislodge material therein and keep the filter-dewatering medium 48 unplugged, non-blinded, clean, and open. The fine solids which have entered and become wedged in the annular spaces 58 between the filter-dewatering rings 56, 56*a*, 56*b* tending to plug or blind the open area of the filter-dewatering medium 48, and the small portions of large solids which have entered the annular spaces 58 between the hoops or rings 56, but cannot pass through and out due to the large portions of the solids being retained on the inner surface 74 of the filter-dewatering medium 48 of the structure 42, are dislodged and pass through and out with the filtrate with the blasting or cleaning action of the filter-dewatering medium cleaning nozzles 90, when the rotating spiral-helical blade or flight 76 of the screw conveyor 43, along with the coil-spring wiping or cleaning blade 87, cuts and scrapes away the solids retained on the inner surface 74 of the medium 48.

The fluid (air or other gas, steam, or water) comes from a suitable fluid supply 92 (such as an air compressor, steam generator, or water supply) and enters the filter-dewatering press 40 via a conduit 93 (see FIGS. 1, 2, 3 and 5), which is aligned with and sealed by a rotating union 94 to the hollow central shaft 75 at the sludge input end 51. A hole 95 in the sludge input end plate 251 of the structure 42 which is aligned with the conduit 93 and the hollow screw conveyor shaft 75 is utilized to provide a non-blocked passage for the fluid to enter the screw conveyor shaft 75. See FIGS. 2, 3, 5, and 6.

Figure 6:
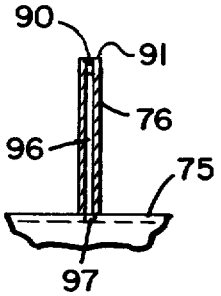
FIG. 6 is a sectional view taken along the line 6—6 in FIG. 5, showing a distribution pipe and filter-dewatering medium cleaning nozzle within the spiral-helical blade or flight of the screw conveyor.
Figure 5:
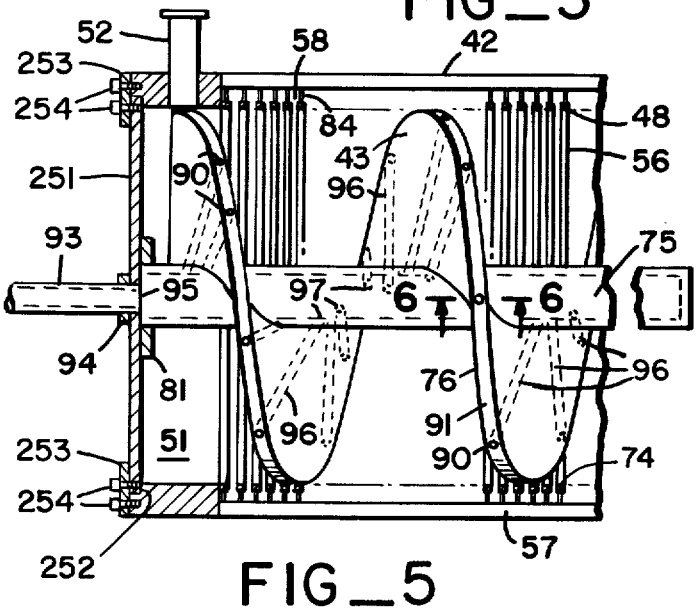
FIG. 5 is a fragmentary sectional view of FIG. 2, showing the distribution pipes for the filter-dewatering medium cleaning nozzles.

FIGS. 3, 5, and 6 illustrate distribution pipes 96 positioned within or being an integral part of, the helical blade or flight 76 of the screw conveyor 43. A filter-dewatering medium cleaning nozzle 90 is attached to each distribution pipe 96 at the outer edge 91 of the blade or flight 76. Numerous holes 97 in the hollow screw conveyor shaft 75 are utilized, each hole 97 being aligned with a distribution pipe 96 for distribution of the air or other gas, steam, or water to the filter-dewatering medium cleaning nozzles 90 from the fluid-filled hollow screw conveyor shaft 75.

Figure 7:
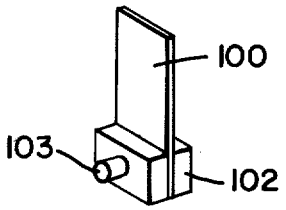
FIG. 7 is an enlarged view in perspective of one cutter or annular slot cleaning blade.

FIGS. 2, 3, and 7 illustrate the nozzles 90 utilized with cutter or annular slot cleaning blades 100 like those of my earlier U.S. Pat. No. 3,695,173. These blades 100 assist the coil-spring wiping blade 87 of FIGS. 33–36 or the blade 98 of FIG. 37, and also assist the nozzles 90 in keeping the filter-dewatering medium 48 or annular spaces 58 between the filter-dewatering rings 56, 56*a*, 56*b* unplugged, non-blinded, clean, and open. The blade 87 or 98, the nozzles 90 and the blades 100, may, however, be utilized independently.

Figure 18:
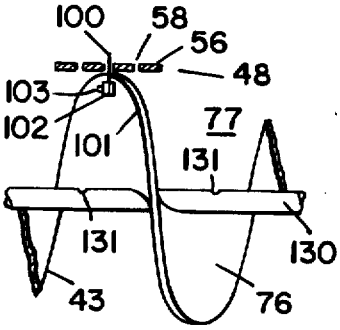
FIG. 18 is a fragmentary section view of a modified form of device showing air or steam ports in the screw conveyor shaft. The cutter or annular slot-cleaning blades are also shown.

When the cutter or annular slot cleaning blades 100 are utilized, they are secured to the outer trailing surface 101 of the sludge compression and dewatered solids discharge screw conveyor helical blade or flight 76 by a cutter blade holder 102 with a spring loaded pin 103, as shown in FIGS. 2, 7, and 18. The blades 100 project out radially and are spaced to extend and lock into their cutting or cleaning position in the annular spaces 58 to positively dislodge material therein and keep the filter-dewatering medium 48 unplugged, non-blinded, clean, and open. The fine solids which have entered and become wedged in the annular spaces 58 between the filter-dewatering rings 56, 56*a*, 56*b* tending to plug or blind the open area of the medium 48, and the small portions of large solids which have entered the annular spaces 58 between the rings 56, 56*a*, 56*b*, but cannot pass through and out, due to the large portions of the solids being retained on the inner surface 74 of the medium 48, are dislodged and pass through and out with the filtrate, due to the cutting or cleaning action of the cutter or annular slot cleaning blades 100, when the rotating spiral-helical blade or flight 76 of the screw conveyor 43, especially when used with the blade 87 or 98, cuts and scrapes away the solids retained on the inner surface 74. The solids tending to clog or blind the annular spaces 58 may be forced back into the spiral-helical extrusion channel 77 by the cutting or cleaning action of the rotating blades 100, depending upon the angle of the blades 100 with respect to the filter-dewatering rings 56, 56*a*, 56*b*, for further pressing and dewatering and for capture within the dewatered solids that have discharged out through the dewatered solids output opening 55 in relatively dry form. The cutter-slot cleaning blades 100 are preferably spring steel-like material.

VARIOUS FORMS OF FILTER-DEWATERING MEDIUM (FIGS. 8–11)

FIGS. 8 through 11 show four different structures which may be used for the rings comprising the medium 48.

Figure 8:
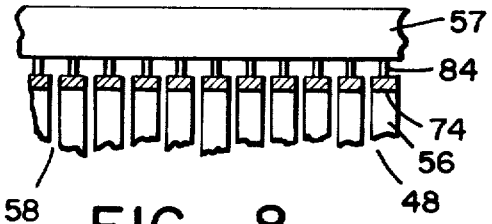
FIG. 8 is an enlarged fragmentary view, partially in section, of the large cylindrical portion of the filter-dewatering structure of FIG. 2.

FIG. 8 is an enlargement of a portion of the filter-dewatering structure 42 of FIG. 2, comprising a series of closely spaced circular filter-dewatering rings 56 which are rectangular in cross section. These rings 56 are in the larger cylindrical portion 50, but the rings in the other portions 53 and 54 could also be rectangular in cross section.

Figure 9:
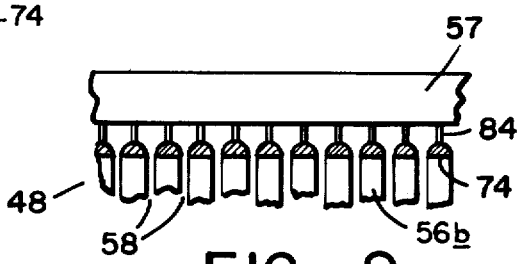
FIG. 9 is a view similar to FIG. 8 of a modified form of the filter-dewatering structure used in the small-diameter cylindrical portion of FIG. 2.

FIG. 9 is an enlargement of another portion of the structure 42 in FIG. 2, namely, the smaller-diameter terminal portion 54, comprising a series of closely spaced circular filter rings 56*b*, semicircular in cross section with the arc thereof facing outwardly to provide outwardly flaring spaces 58 between adjacent rings 56*b*. In the frustoconical portion 53 of FIG. 2, the rings 56*a* are also shown as semicircular. The rings in the portion 50 could also be semicircular in cross section.

Figure 10:
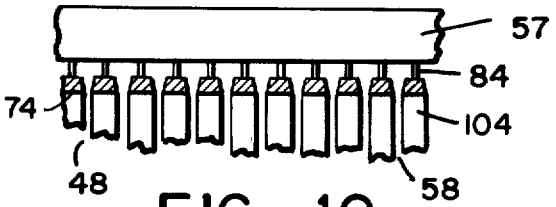
FIG. 10 is a view similar to FIG. 8 of a modified form of the filter-dewatering structure.

FIG. 10 is a view like FIGS. 8 and 9 showing a series of closely spaced circular filter-dewatering rings 104 that are wedge-shape or trapezoidal in cross section. I have found that to obtain the maximum surface life and minimum plugging or blinding, from such rings 104, the sides of the wedge rings 104 should be sloped 5° from the vertical. The filter-dewatering rings 104 may even be triangular shape in cross section and may make up the filter-dewatering medium 48 of the portions 50, 53 and 54.

Figure 11:
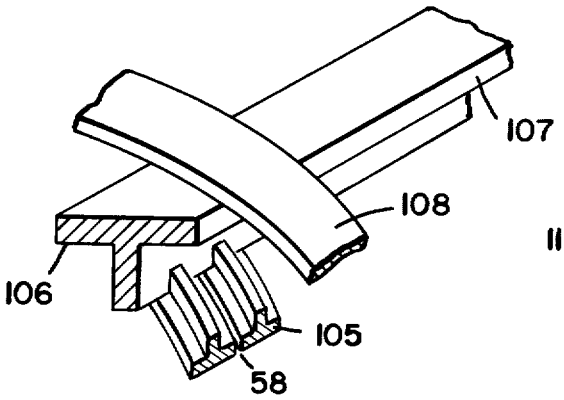
FIG. 11 is a view in perspective similar to FIG. 8 of a modified form of the filter-dewatering structure.

FIG. 11 is a perspective view of a series of closely spaced circular filter-dewatering rings 105, having a T cross section and a reinforcing frame 106 that is also T-shaped in cross section. The frame 106 comprises a series of longitudinally extending support rods 107 machined for positioning the filter-dewatering rings 105, and circular holding bands 108 for holding the support rods 107 and the filter-dewatering rings 105 rigid. The open area or annular spaces 58 between the filter-dewatering rings 105 may be varied with a change of support rods 107 utilizing the same hoops or rings 105. Disassemblage also enables replacement or resurfacing of the rings 105.

Figure 12:
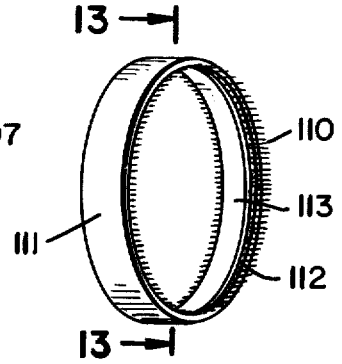
FIG. 12 is an enlarged view in perspective of a filter-dewatering hoop or ring showing an annular slot-reducing or space-bridging member attached to a recessed surface or interior of the hoop or ring to reduce or partially close the space or annular opening.
Figure 13:
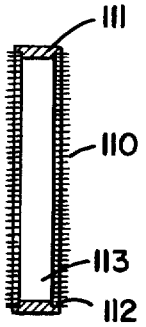
FIG. 13 is a view in section taken along the line 13—13 in FIG. 12.

For greater solids capture within the filter-dewatering press 40, annular slot-reducing or space-bridging members 110 of my U.S. Pat. No. 3,695,173 may be used for bridging or partially closing and reducing the annular space 58 between filter-dewatering rings 111 generally like the rings 56. See FIGS. 12 and 13. These slot-reducing members 110 are capable of backward or lateral movement when engaged by the cutter or annular slot-cleaning blades 100, if these are also utilized, enabling the cutter-slot cleaning blades 100 to pass and keep the annular spaces 58 between successive filter-dewatering rings 111 clean or unclogged. However, the bridging or slot-reducing member 110 has the resilience to spring back to bridge or reduce the annular spaces 58 after passage of the cutter-slot cleaning blades 100. The ring 111 of FIGS. 11 and 12 is fabricated or machined to provide a recessed surface 112 on the interior of the filter-dewatering ring 111 for attachment of the slot-reducing or space-bridging members 110 and enables a smooth and uniform inner surface 113, with the members 110 in place, for the rotation of the spiral-helical blade or flight 76 of the screw conveyor 43 and conveyed solids. The members 110 shown to bridge or partially close the annular spaces 58 between the filter-dewatering rings 111 may be stainless steel bristles or other suitable material.

Figure 14:
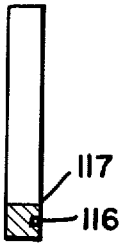
FIG. 14 is a fragmentary section view of a filter-dewatering hoop or ring and spring loaded wire for use as the filter-dewatering ring and annular space bridging or closing member respectively.

FIG. 14 shows a rectangular in cross section circular filter-dewatering ring 115 along with a spring-loaded rough-surfaced or crimped wire 116 serving as an annular space bridging or closing member. The side 117 of the ring 115 which forms one edge of an annular space 58 that lies between it and another closely spaced ring 115 is preferably machined with a groove to accept and position the spring-loaded wire 116. By the spring action of the wire slot-reducing or space-bridging member 116, the wire 116 is capable of backward or lateral movement when engaged by the cutter or annular slot cleaning blade 100 enabling the blades 100 to pass and keep the annular spaces 58 between the filter-dewatering rings 115 clean or unclogged and the wire slot reducing or space-bridging member 116 springing back to bridge or reduce the annular spaces 58 after passage of the cutter-slot cleaning blades 100.

Figure 15:
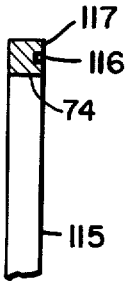
FIG. 15 is an enlarged view in perspective of a filter-dewatering ring with a rectangular access opening and plug.
Figure 15:
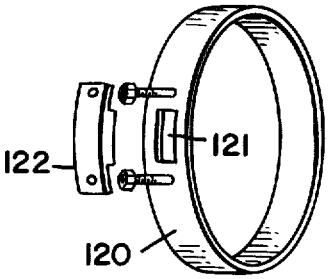

FIG. 15 shows a filter-dewatering ring 120 having a rectangular access opening 121 normally plugged or closed by a plug 122. The access opening 121 enables entry or access into the filter-dewatering structure 42 at each filter-dewatering ring 120, for such work as cleaning the filter-dewatering medium cleaning nozzles 90; inserting, positioning, or replacement of cutter or annular slot cleaning blades 100; or just general inspection.

Figure 16:
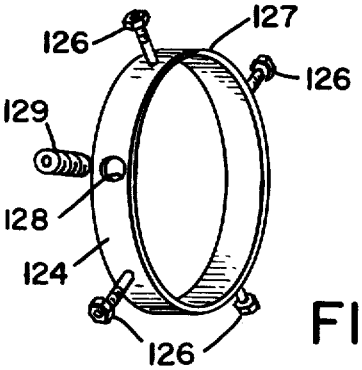
FIG. 16 is an enlarged view in perspective of a filter-dewatering ring showing threaded pins and nuts for bolting to the support rods or reinforcing frame. An access hole and a set screw therefor are also shown.
Figure 17:
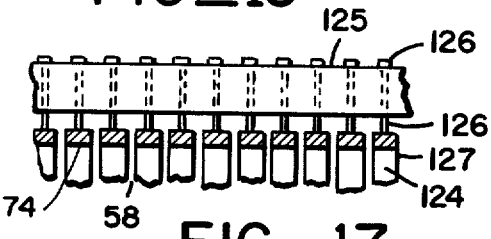
FIG. 17 is an enlarged fragmentary view, partially in section, of a portion of the structure utilizing the filter-dewatering rings of FIG. 16, showing bolting of the rings to the support rods.

As shown in FIGS. 16 and 17, bolting of a modified form of a filter-dewatering ring 124 to a reinforcement frame 125 enables disassemblage. Bolting also enables the annular spaces 58 between successive rings 124 to be varied with a change of the reinforcing frame 125, utilizing the same filter-dewatering rings 124. FIGS. 16 and 17 show threaded filter-dewatering ring bolts with nuts 126 for bolting and holding together the rings 124 and its reinforcing frame 125 as a single unit. Disassemblage also enables replacement or resurfacing of the side edges 127 of the rings 124 when the annular spaces 58 formed by successive rings 124 exceed an established permissible spacing 58 and also enables replacement of a wire slot-reducing or space-bridging member 116 that may be utilized with the filter-dewatering ring 115 of FIG. 11. FIG. 16 also shows a threaded round access hole 128, normally plugged or closed by set screws 129.

Figure 19:
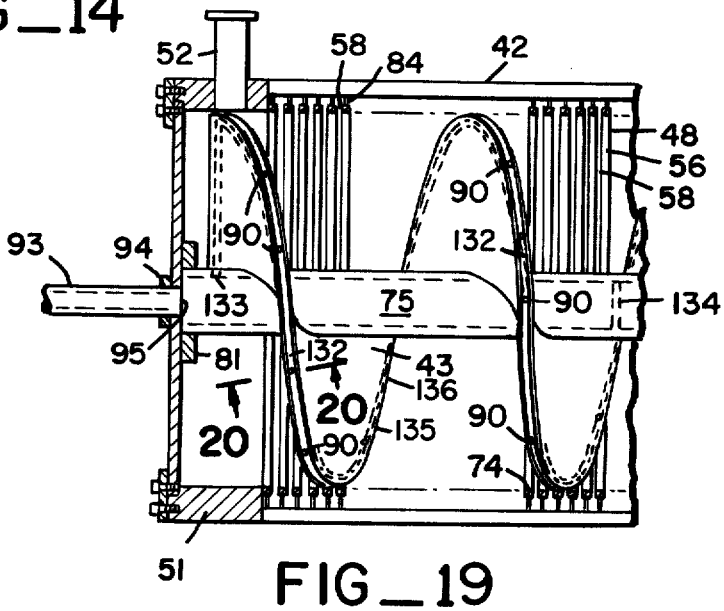
FIG. 19 is a fragmentary sectional view showing a distribution pipe for the filter-dewatering medium cleaning nozzles in accord with a modified embodiment of the invention.
Figure 20:
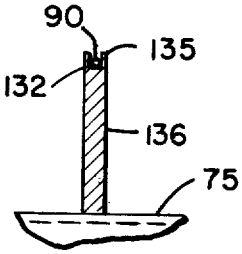
FIG. 20 is a sectional view along the line 20—20 in FIG. 19 showing the distribution pipe and a filter-dewatering medium cleaning nozzle within the outer edge of the spiral-helical blade of the screw conveyor.

MODIFIED FORMS OF SCREW CONVEYOR SHAFTS (FIG. 18) AND CLEANING NOZZLES (FIGS. 19 AND 20)

FIG. 18 illustrates a modified form of a central shaft 130 for the sludge compression and dewatered solids discharge screw conveyor 43. The shaft 130 has ports 131 for air, steam, or other fluid, and these ports 131 may be adjustable, which are an integral part of, or are secured into position on, to add air, steam, or other fluid, to the sludge within the filter-dewatering structure 42. The air or steam for the ports or adjustable outlets 131 may enter the filter-dewatering press 40 via the conduit 93 which is aligned with and sealed by a rotating union 94 to the hollow central shaft 130, as in FIG. 5. Air or steam not required for the filter-dewatering medium cleaning nozzles 90 can then enter the sludge via the ports 131 in the screw conveyor shaft 130 to maximize dewatering of sludge at minimum cost.

As an alternative, air, steam, or other fluid may be added directly to the sludge prior to the press 40 proper by injection into the sludge inlet conduit 46 or the inlet connection 52, eliminating the fluid outlets 131 and utilizing the screw conveyor central shaft 75 of FIG. 2.

FIGS. 19 and 20 show another embodiment wherein numerous cleaning nozzles 90 are connected to a common air or other gas, steam, or water distribution pipe 132. The distribution pipe 132 follows within a U-shaped outer edge 135 of a helical blade or flight 136 of the screw conveyor 43 as shown in FIG. 20, or it may be attached to the outer trailing surface of the blade 136. The common distribution pipe 132 is connected to the air or other gas, steam, or water-filled hollow central shaft 75 of the sludge compression and dewatered solids discharge screw conveyor 43 via two holes 133 in the shaft 75, one at the sludge input end 51 and the other at the dewatered solids output opening 55, for distribution of the air or other gas, steam, or water to the filter-dewatering medium cleaning nozzles 90. A blocking plate 134 may be utilized to close or seal the hollow screw conveyor shaft 75 toward the dewatered solids output opening 55.

APPLICATION OF DIFFERENT LEVELS OF VACUUM (FIG. 21)

Figure 21:
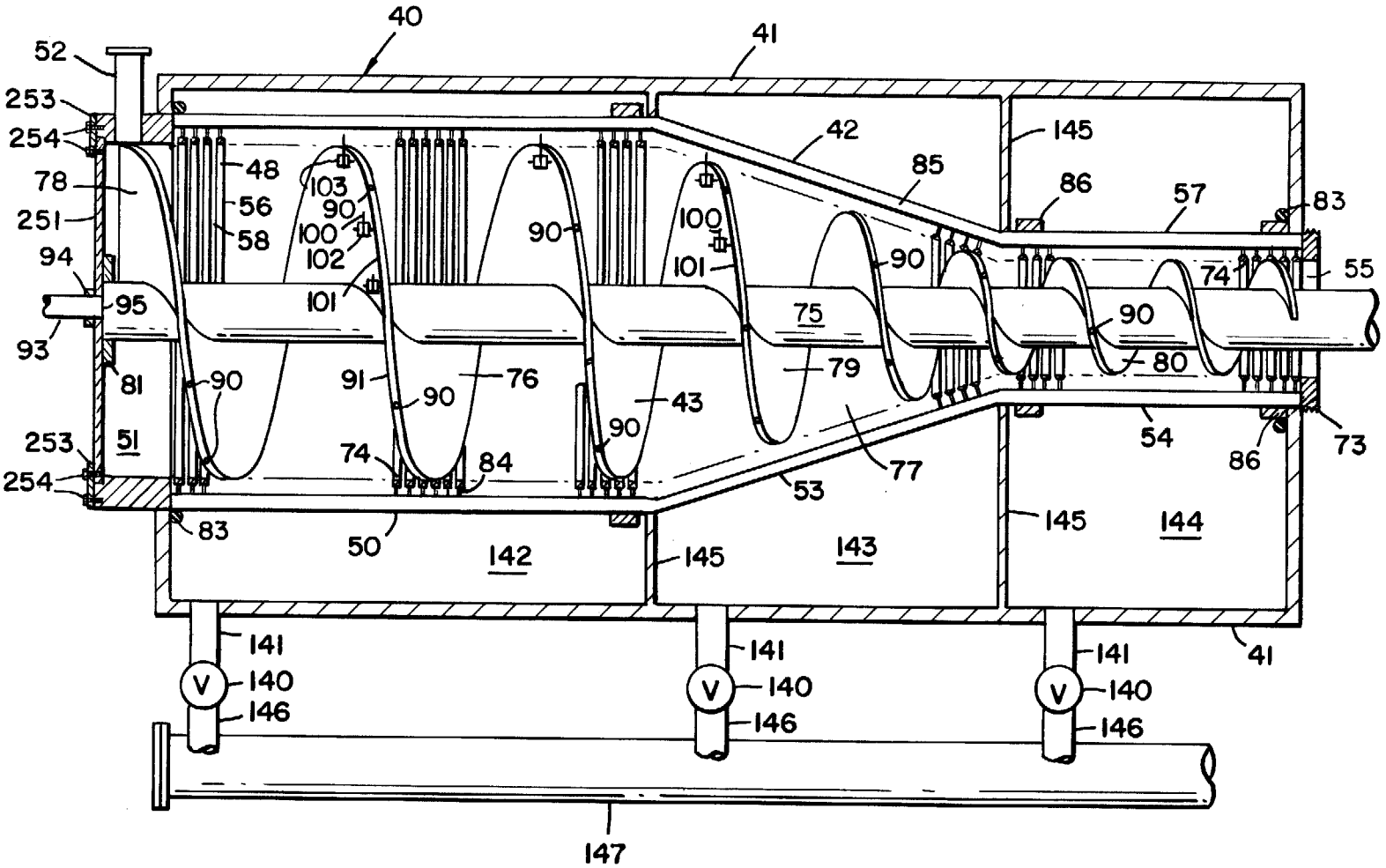
FIG. 21 is a side elevational view, partially in section, of a filter-dewatering-expression press in accord with a modified embodiment of the invention.

Different levels of vacuum may be applied to the initial cylindrical portion 50, the frustoconical portion 53, and the terminal cylindrical portion 54, by valves 140 and conduits 141, as shown in FIG. 21. In this case, the imperforate filtrate or liquid collection housing 41 is divided into three individual compartments 142, 143, and 144, surrounding the initial cylindrical portion 50, the frustoconical portion 53, and the terminal cylindrical portion 54, respectively. This is done by partitions 145, with each compartment having a liquid or filtrate outlet 146 connecting a common header conduit 147 which is connected to the vacuum pump 60.

PRESSES HAVING MODIFIED FORMS OF SCREW CONVEYORS (FIGS. 22–25)

In each of the screw conveyors of FIGS. 22–25, the blade 87 or 98, though not shown here, is generally present.

Figure 22:
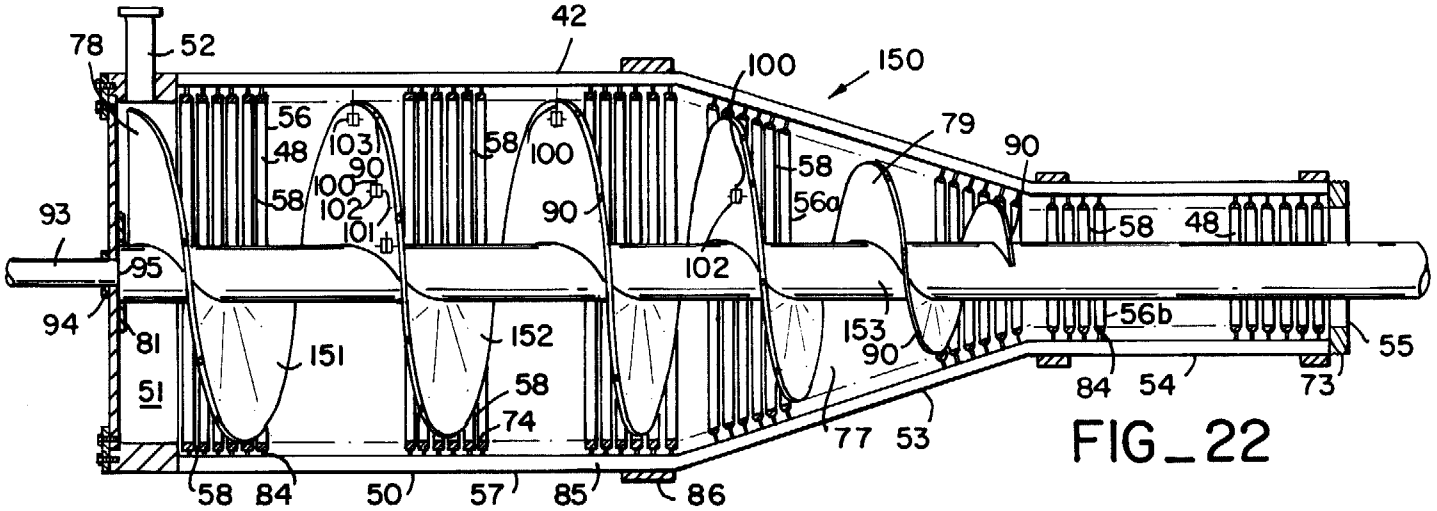
FIG. 22 is a side elevational view, partially in section, of a filter-dewatering press having a modified form of the combination sludge compression and dewatered solids discharge screw conveyor, the screw blade being present only in the first two of the three major sections.

FIG. 22 shows a modified form of press 150 in which the filter-dewatering structure 42 is in combination with a modified form of combination sludge-compression and dewatered-solids-discharge screw conveyor 151. The screw conveyor 151 has a spiral-helical blade or flight 152 mounted on a central shaft 153 and conforming closely to the inner surface 74, within the initial cylindrical portion 50 and the frustoconical portion 53 only. The spiral-helical blade or flight 152 does not continue within the terminal cylindrical portion 54, in order that there be a dewatered solids or plug within the terminal cylindrical portion 54. The coil-spring blade 87 or 98 of FIGS. 33–37 and the cleaning nozzles 90 are preferably utilized along with the cleaning blades 100 in the initial cylindrical portion 50 and the frustoconiical portion 53. The open areas of the annular space 58 between the filter-dewatering rings **56*b* in the terminal cylindrical portion 54 tend to remain clean and open, particularly when the filter-dewatering rings 56*b* or 104 of FIGS. 9 or 10 are utilized, due to the divergence of the annular space 58 and the flushing action of the filtrate on the solids held by the knife blade edges of the rings 56*b* or 104 and the movement of the dewatered solids in the terminal cylindrical portion 54 by the screw conveyor 151** ahead of it.

Figure 23:
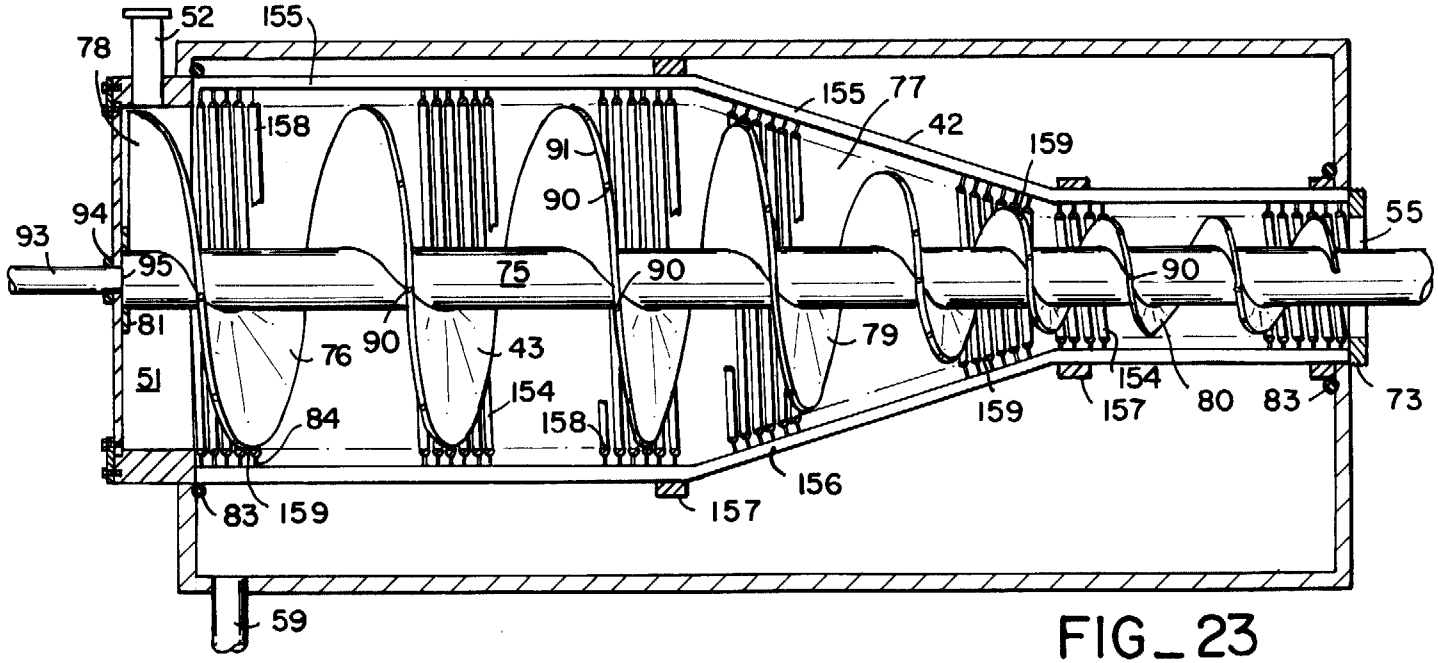
FIG. 23 is a side elevational view, partially in section of a filter-dewatering-expression press in accord with a modified embodiment of the invention wherein the filter-dewatering structure comprises a single helically wound wire specially processed.

FIG. 23 illustrates another embodiment of this invention whereas the structure 42 comprises a continuous wire 154 closely wound into a coil and held rigid by a reinforcing frame 155, which is a series of support rods 156 with circular holding bands 157 The continuous wire 154 is here the filter-dewatering medium corresponding to the medium 48. The wire 154 has its inner surface 158 finished smooth as by grinding, to one-half as thick as the diameter of circular wire, which may be the original wire. Hence, the wire 154 is semicircular in cross section, to provide a uniform inner surface 158 and a narrow continuous spiral diverging slot or opening 159 for filtrate or liquid passage, and for easy conveyance and discharge of the dewatered solids. To prevent plugging or blinding of the narrow continuous diverging slot or opening 159, defined by the space between the successive windings of the continuous wire 154, the cleaning or wiping blade 87 or 98 and the cleaning nozzles 90 are preferably utilized, being an integral part of, or attached to the outer edge 91 of the screw conveyor helical blade or flight 76, projecting out radially and spaced to discharge under pressure, a forceful blast of the air or other gas, steam, or water into the continuous spiral slot or opening 159, to positively dislodge material therein and keep the filter-dewatering medium unplugged, non-blinded, clean, and open.

Figure 24:
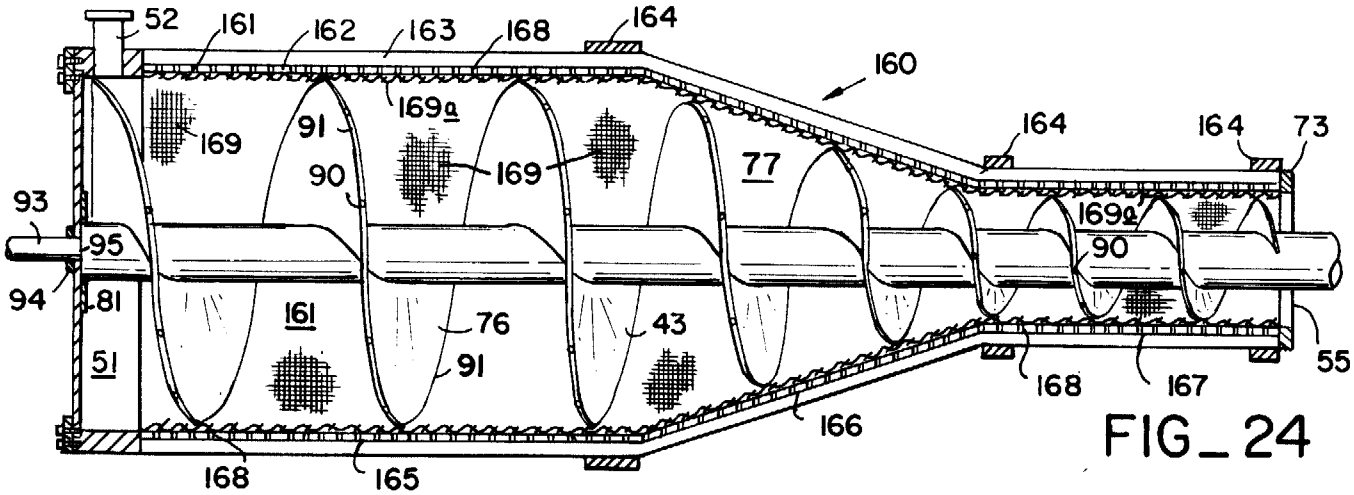
FIG. 24 is a view similar to FIG. 23 of a modified form of press embodying the invention, having its filter-dewatering structure provided by a foraminous shell or screen.

FIG. 24 shows another embodiment of this invention having a somewhat different filter-dewatering structure 160 in place of the structure 42. The structure 160 comprises a flow-impeding filter-dewatering screen 161, held rigid within and supported by, a perforated housing 162, reinforced with reinforcing rods 163 and circular holding bands 164. The perforated housing 162 comprises a perforated metal sheet or screen having an initial cylindrical portion 165, which is rigidly attached to a frustoconical portion 166, which is rigidly attached to a smaller diameter terminal cylindrical portion 167. The housing 162 has holes 168. The filter-dewatering screen 161 of FIG. 24 preferably is a stainless steel screen with opening 169.

The perforated sheet or screen used in fabrication of this housing 162 may be of various thicknesses and may have various hole diameters providing various open areas. I have found that one-eighth inch stainless steel sheeting having three-sixteenth inch diameter round holes 168 at one-fourth inch staggered centers will provide approximately 53 percent open area and that the three sections 165, 166, and 167, along with the reinforcing rods 163 and the circular holding bands 164, will provide strength to carry the load of solids and pressures developed within the structure 160 and can be readily fabricated. The thickness of the screen 161, and the diameter and location of the perforations or openings 169 may be of various dimensions to provide various open areas and to define the size of particle which the screen 161 will retain. I have found that 0.015 inch plate thickness screen 161 with 0.015 inch nominal round openings 169, which provides approximately 22 percent open area, will have a good solids capture when dewatering sewage sludge, and can be readily fabricated. The screen 161 may be manufactured by an electrolytic etching process. The screen 161 may be designed so as to avoid plugging or blinding at the perforations 169 by oversize material. The perforations or openings 169 are a tapered conical hole, largely tapered from the outside.

As the solids are deposited or retained on the inner surface 169*a* of the filter-dewatering screen 161 with the filtrate being expelled from the structure 160 via the perforations 169 or open area of the screen 161 and the holes 168 of the housing 162, the rotating sludge-compression and dewatered-solids-discharge screw conveyor 43 (preferably provided with the blade 87 or 98) cleans and scrapes the solids from the inner surface 169*a* of the screen 161 and conveys the sludge and solids through the structure 160 for further pressing and dewatering, and out the dewatered solids output opening 55, relatively dry. To assist the blade 87 or 98 in preventing plugging or blinding of the perforations 169 or open area of the filter-dewatering screen 161 and interruption of continuous filtration-dewatering, the cleaning nozzles 90 are utilized, being an integral part of, or attached to the outer edge 91 of the screw conveyor helical blade or flight 76, projecting out radially and spaced to discharge under pressure, a forceful blast of the air or other gas, steam, or water into the perforations 169 of the screen 161, to positively dislodge material therein and keep the filter-dewatering screen 161 unplugged, non-blinded, clean, and open.

The fine solids which have entered and become wedged in the perforations 169 of the screen 161, tending to plug or blind the screen 161, and the small portions of large solids which have entered the perforations 169 but cannot pass through anad out due to the large portions of the solids being retained on the inner surface 169*a*, are dislodged and pass through and out with the filtrate with the blasting or cleaning action of the screen cleaning nozzles 90, when the helical blade or flight 76, along with the coil-spring blade 87 or 98, cuts and scrapes away the solids retained on the inner surface 169*a*.

Figure 25:
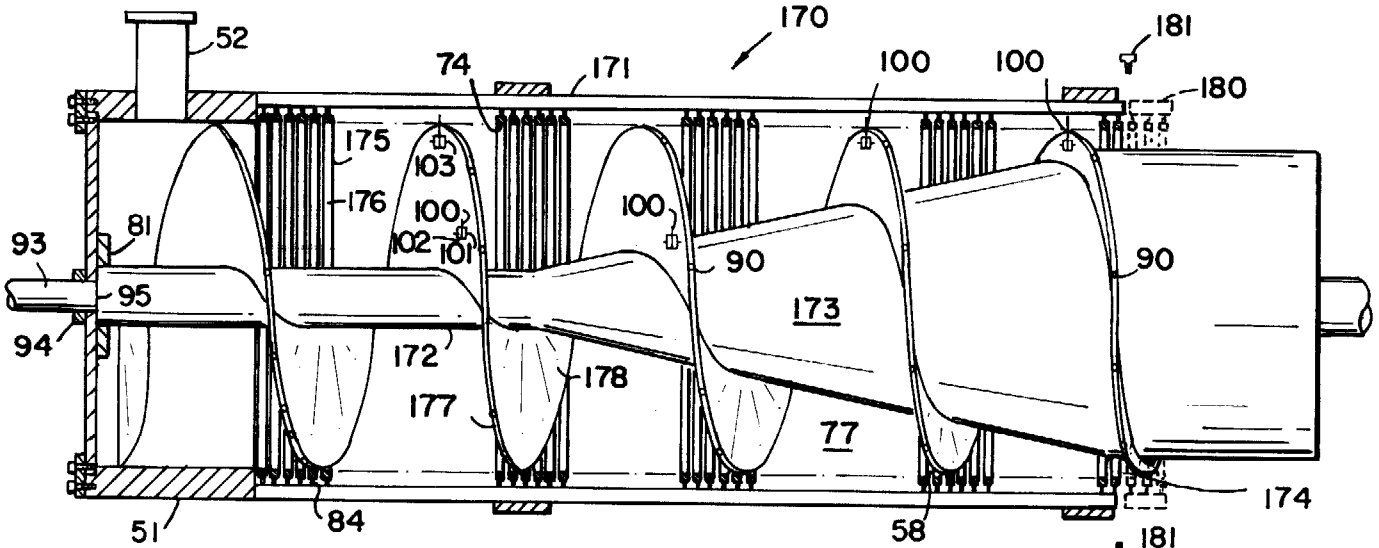
FIG. 25 is a view similar to FIG. 23 of another modified form of press embodying the invention and having a cylindrical filter-dewatering portion in combination with a screw conveyor having a shaft that varies in diameter from a small-diameter entering portion to a large-diameter terminal portion.

FIG. 25 illustrates another embodiment of this invention. Here, there is a press 170 comprising a filter-dewatering cylindrical structure 171 and a rotating screw conveyor 172 with a central shaft 173 that is tapered, increasing in diameter toward a dewatered solids output opening 174. As a result, the pressure or compression is increased upon the sludge, and filtration, dewatering, or expression can be achieved. The structure 171 has a filter-dewatering medium 175 shown as the closely spaced circular filter-dewatering rings 176 rectangular in cross section, but any of the types of rigidly held closely spaced circular filter-dewatering rings previously illustrated may be used and it may comprise a rigidly held continuous wire like the wire 154 or a rigidly held filter-dewatering screen like the screen 161.

To prevent plugging or blinding of the open area of the filter-dewatering medium 175, the blade 87 or 98 and the filter-dewatering medium-cleaning nozzles 90 are utilized; the nozzles 90 may be an integral part of, or attached to the outer edge 177 of the screw conveyor helical blade or flight 178, projecting out radially and spaced to discharge, under pressure, a forceful blast of the air or other gas, steam, or water into the open area of the filter-dewatering medium 175, to positively dislodge material therein and keep the open area unplugged, non-blinded, clean, and open. The cutter or annular slot cleaning blades 100 may also be utilized where appropriate to assist blade 87 or 98 and the nozzles 90 in keeping the filter-dewatering medium 175 unplugged, non-blinded, clean, and open.

Additional filter-dewatering medium 180 (shown dotted in FIG. 25) may be attached to the structure 171 by bolts 181 to increase the length of the structure 171 toward the output opening 174, and (in conjunction with the tapered central shaft 173 of the rotating screw conveyor 172) this increases the pressure or compression upon the sludge and varies the quantity and dryness of the dewatered solids being discharged out the output opening 174.

PLURAL-SECTION SCREW CONVEYORS (FIGS. 26–30)

FIGS. 26–30 illustrate a group of modified embodiments of this invention wherein plural-section screw conveyors are utilized within a filter-dewatering structure. Here again, the blade 87 or 98 is preferably present, though not shown in the drawings. Each section of the screw conveyor is capable of being rotated at a different speed, and the difference in speeds is used to regulate the quantity and dryness of the dewatered solids being discharged from the press. A differential gear drive, such as a planetary gear drive may be used to obtain the differential speed desired. A double-shaft drive unit may be used to drive both shafts concentric to each other, so that each shaft and each conveyor section can have independent speed of rotation. The differential speed of rotation between the screw conveyor sections may be controlled automatically by a torque-sensing actuator device wired to the drive unit. The filter-dewatering structure 42 of FIG. 2 is shown; however, other filter-dewatering structures previously described may be used.

Figure 26:
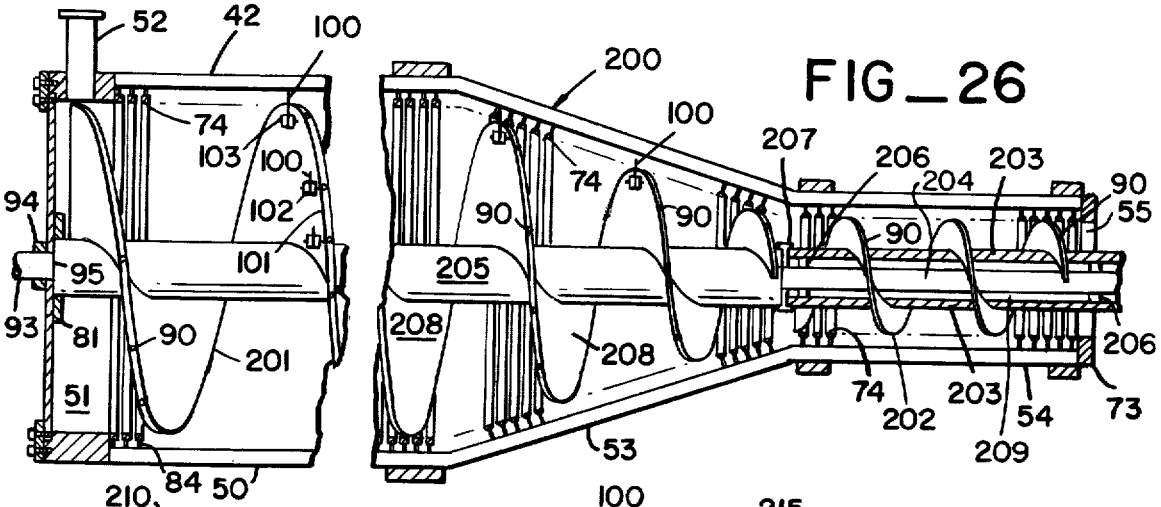
FIG. 26 is a view similar to FIG. 23 of another modified form of press embodying the invention, wherein a plural-section screw conveyor is used to provide different speeds in each of two different portions of the press.

In FIG. 26, a press 200 comprises the structure 42 in combination with a screw conveyor 201. The screw conveyor 201 has a spiral-helical blade or flight 202 in the terminal cylindrical portion 54 of the filter-dewatering-expression press 200, the filtrate housing 41 not being shown. The blade 202 is the dewatered solids discharge screw conveyor section. The flight or blade 202 is mounted on an outer shaft 203 which slips over, is concentric to, and rotates around a reduced diameter portion 204 of a main shaft 205 for the screw conveyor 201. The shaft 203 is supported for rotation relative to the shaft portion 204 by bearings 206, and sealed by a seal 207 to the main shaft 205. There is a space 209 between the shaft 203 and the shaft portion 204. The main shaft 205 supports a spiral-helical blade or flight 208 in the initial cylindrical portion 50 and in the frustoconical portion 53 of the structure 42. This blade 208 may be referred to as the sludge feed and compression screw conveyor section, and it is a continuous spiral-helical blade; it follows closely the uniform inner surface 74 of the initial cylindrical portion 50 and of the frustoconical portion 53. Both blades 202 and 208 of the screw conveyor 201 are of the same "hand," and rotate in the same direction of rotation. The helical blade or flight 202 follows closely the uniform inner surface 74 of the terminal cylindrical portion 54. The coil-spring wiping or cleaning blade 87 or 98 and the cleaning nozzles 90 are utilized as before along with cutter or annular slot cleaning blades 100 in the initial cylindrical portion 50 and in the frustoconical portion 53, and the cutter or annular slot cleaning blades 100 may be utilized in the terminal cylindrical portion 54. Also, a coil-spring blade 87 or 98 and cleaning nozzles 90 may be utilized in the terminal cylindrical portion 54. The fluid for the nozzles 90 may be introduced into the space 209 and by using distribution pipes (not shown) to connect the space 209 to the nozzles 90.

Figure 27:
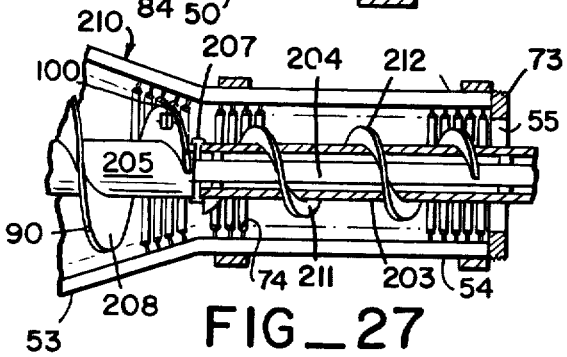
FIG. 27 is a view similar to FIG. 26 and represents a modification thereof, wherein the edge of the terminal portion of the screw does not wipe the terminal portion of the filter-dewatering structure but is spaced radially inwardly therefrom.

FIG. 27 illustrates a press 210 which is like the press 200 of FIG. 26 except that it has a spiral-helical blade or flight 211 in the dewatered solids discharge section 54 which does not follow closely the uniform inner surface 74 of the terminal cylindrical portion 54. Instead, the diameter of the spiral-helical blade or flight 211 is approximately one-half the diameter of the dewatered solids output opening 55. Its edge 212 thus does not wipe the surface 74 but is spaced apart from it. No coil-spring blade 87 or 98, no cleaning nozzles 90, and no cutter or annular slot cleaning blades 100 are utilized in the terminal cylindrical portion 54.

Figure 28:
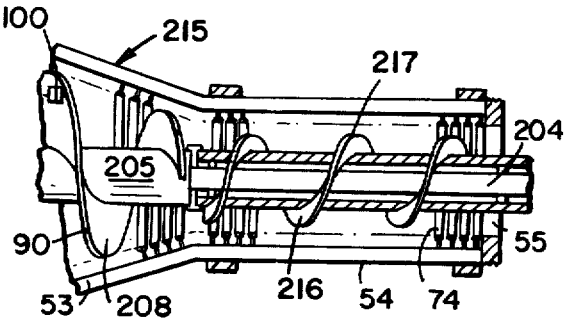
FIG. 28 is a view similar to FIG. 27 showing another modification, wherein the terminal portion of the screw is of opposite hand from the remainder of the screw.

FIG. 28 shows a press 215 much like the press 210 and differing only in that it has screw conveyor section 216 in the terminal cylindrical portion 54 that is of different "hand" from the main screw conveyor 208 in the initial cylindrical portion 50 and in the frustoconical portion 53. The dewatered solids discharge screw conveyor section 216 in the terminal cylindrical portion 54 does not follow closely the uniform inner surface 74, but its edge 217 spaced from it, like the diameter of the edge 212 of the screw 211 of FIG. 27. The spiral-helical blade or flight 208 may be an interrupted helical or spiral flight arrangement, and the helical blade or flight 216 may be replaced by a single flight ribbon. Preferably, a coil-spring wiping or cleaning blade 87 or 98 and cleaning nozzles 90, along with the cutter or annular slot cleaning blades 100, are utilized in the initial cylindrical portion 50 and in the frustoconical portion 53.

Figure 29:
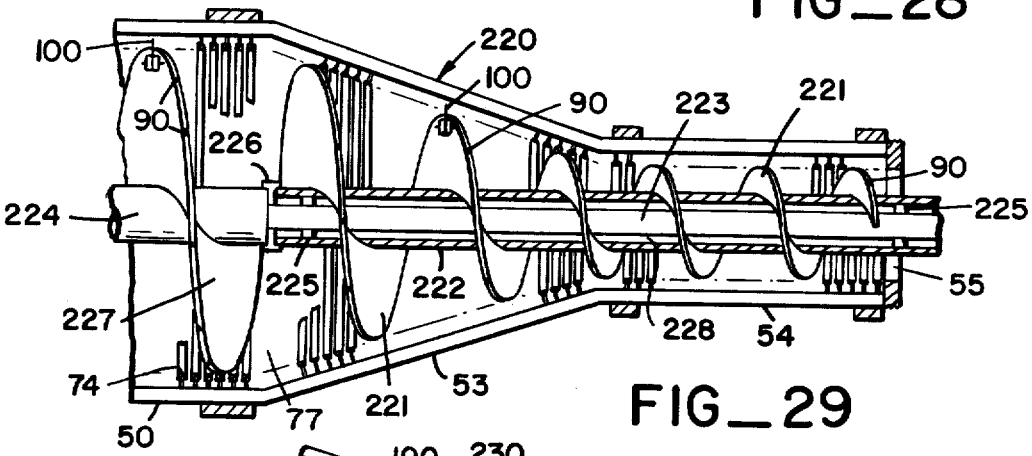
FIG. 29 is a view similar to FIG. 26 having a somewhat different type of plural-section screw conveyor.

FIG. 29 shows a press 220 having another type of plural-section sludge-compression and dewatered-solids-discharge screw conveyor. A helical blade or flight section 221 in the frustoconical portion 53 and in the terminal cylindrical portion 54 is a continuous helical blade, and is mounted on an outer tubular shaft 222 which slips over, is concentric with, and rotates around a reduced-diameter portion 223 of a shaft 224. The shaft 222 is supported for rotation relative to the shaft portion 223 by bearings 225 and is sealed by a seal 226. A screw conveyor section 227 in the initial cylindrical portion 50 comprises a spiral-helical blade or flight mounted on the shaft 224. Both screw conveyor sections 221 and 227 rotate in the same direction of rotation in this embodiment, and are both of the same "hand." Both spiral-helical blades 221 and 227 follow closely the uniform inner surface 74 of the initial cylindrical portion 50 and of the frustoconical portion 53 and may follow closely the uniform inner surface 74 of the terminal cylindrical portion 54, as in FIG. 29. Preferably, a coil-spring wiping blade 87 or 98 and cleaning nozzles 90 are utilized, along with the cutter or annular slot cleaning blades 100 in the initial cylindrical portion 50. Both a coil-spring blade 87 or 98 and cutter or annular slot cleaning blades 100 may be utilized in the frustoconical portion 53 and in the terminal cylindrical portion 54. Cleaning nozzles 90 may also be utilized in the portions 53 and 54 by conducting their fluid via the space 228 between the shaft 222 and the shaft portion 223 and by using distribution pipes (not shown) to connect the space 228 to the nozzles 90.

Figure 30:
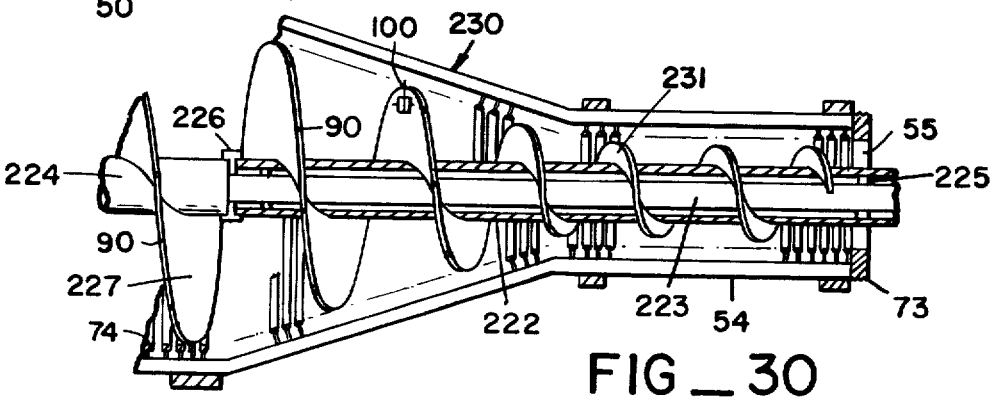
FIG. 30 is a view similar to FIG. 29 in which the terminal portion of the screw conveyor is spaced upwardly from the filter-dewatering structure, as in FIG. 27.

FIG. 30 shows a press 230 generally like the press 220 and differing only in that it has a spiral-helical blade or flight 231, which in the terminal cylindrical portion 54 does not follow closely the uniform inner surface 74, but instead, in that portion has a diameter approximately one-half the diameter of the dewatered solids output opening 55. No coil-spring blade 87 or 98, no cutter or annular slot cleaning blades 100, and no cleaning nozzles 90 are utilized in this terminal cylindrical portion 54.

The differential speed of rotation of the plural-section sludge compression and dewatered solids discharge screw conveyors and the counter pressure which can be created in the different portions of the structure 42 of FIGS. 26, 27, 29, and 30, and the counterdischarge effect as in FIG. 28 when the screw conveyor sections 208 and 216 are of opposite "hand," along with other design parameters of the dewatering press enable regulation of the detention time of the sludge within the different portions 50, 53, and 54 changing the dewatering and compression rates within the different portions 50, 53, and 54, therefore controlling the quantity and dryness of the dewatered solids discharged from the press.

Figure 31:
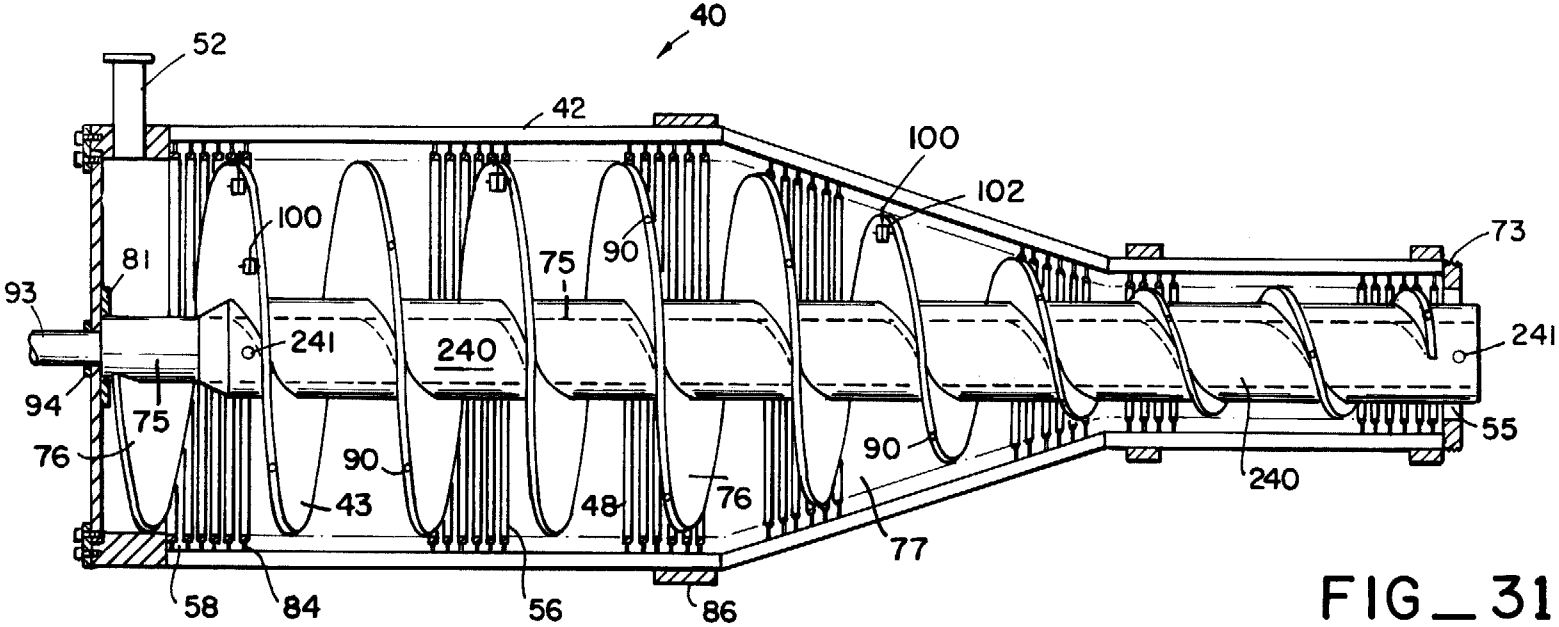
FIG. 31 is a view similar to FIG. 2 of another modified form of the invention.
Figure 32:
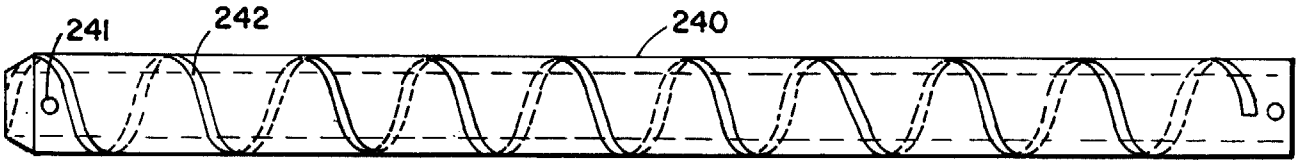
FIG. 32 is a view in side elevation of a helical shape wrap shown in FIG. 31 as part of the assembly.

ANOTHER MODIFIED FORM OF SCREW CONVEYOR (FIGS. 31 and 32)

FIG. 31 illustrates still another embodiment wherein the diameter of the central shaft 75 of the screw conveyor 43 may be increased if desired. For example, such an increase may be desired if the nature and consistency of the sludge to be dewatered warrants it. Increase in the diameter of the shaft reduces the volume within the filter-dewatering structure 42 or extrusion channel 77, and at the same time, decreases the dewatered solids output opening 55, increasing the pressure or compression upon the sludge and varying the quantity and dryness of the dewatered solids being discharged out the output opening 55. This can be done by one single adjustment or addition to the dewatering press 40, namely, by using a removable spiral shaft wrap 240, rotated over and wound around, covering the constant diameter central shaft 75, threading the constant-pitch spiral-helical blade or flight 76 of the screw conveyor 43, and held into position as by set screws 241. The blade 87 or 98, though not shown specifically in the drawings is preferably present.

FIG. 32 shows the removable continuous spiral shaft wrap 240 removed from the constant pitch spiral-helical blade or flight 76 of the constant diameter central shaft 75 of the screw conveyor 43. The wrap 240 has a spiral slot 242 for threading the constant pitch spiral-helical blade or flight 76. The shaft wrap 240 may be formed or rolled steel.

For the central shaft 75 of the screw conveyor 43 which has a variable pitch blade or flight 76, as in FIG. 2, the covering or shaft wrap 240 may be cut to fit, plasticized polyvinyl chloride or rubber material, wrapped or wound and held rigid as by set screws 241 of the central shaft 75, decreasing the volume within the structure 42 or solids extrusion channel 77 and decreasing the dewatered solids output opening 55, increasing the pressure or compression upon the sludge or solids and varying the quantity and dryness of the dewatered solids being discharged out the output opening 55.

Pressures inside the filter-dewatering-expression press 40 may reach 2000 lb./sq.in. or more. The exact pressure will depend upon the design parameters of the individual press and the nature and consistency of the sludge or slurry to be dewatered.

The speed of rotation of the sludge compression and dewatered solids discharge screw conveyor 43 may vary from about 10 rpm to over 200 rpm.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A device for dewatering sludge, including in combination:

a filter-dewatering shell having an initial portion, a succeeding portion and a terminal portion, each comprising means for exit of fluid and retention of solid particles, filtrate collection means outside said shell and spaced therefrom for collecting filtrate, central shaft means along the axis of said filter-dewatering shell, the distance between said shaft means and said shell being a constant maximum distance in said initial portion and decreasing in said succeeding portion to a minimum in said terminal portion, wiping, compressing, and filter-cake-discharging means secured to said shaft means and wiping the inner surfaces of said shell, power means for rotating said shaft means, nozzle means on the outer edge of said wiping, compressing, and filter-cake-discharging means facing said shell, and fluid supply means for supplying said nozzle means with fluid for cleaning out said means for exit.

2. The device of claim 1 wherein said wiping, compressing, and filter-cake-discharging means comprises a spiral-helical blade provided with a coil-spring wiping blade positioned along the radially outer edge of said spiral-helical blade.

3. The device of claim 2 wherein said spiral-helical blade is provided with radially outwardly extending conduits leading to said nozzle means, said shaft means having passage means connected to said conduits and comprising therewith part of said fluid supply means.

4. The device of claim 2 wherein said coil-spring wiping blade comprises a metal spring rectangular in cross section with one end secured rigidly to said spiral-helical blade.

5. The device of claim 4 wherein said wiping blade is positioned to one side of said radially outer edge of said spiral-helical blade by a series of guide clips secured to said spiral-helical blade.

6. The device of claim 2 wherein said wiping blade comprises a continuous strip of plastic, rectangular in cross section and containing a coil-spring wire.

7. The device of claim 2 wherein said spiral-helical blade has a groove in its said radially outer edge and said wiping blade is positioned therein.

8. The device of claim 1 wherein said wiping, compressing, and filter-cake-discharging means comprises a spiral-helical blade provided with radially outwardly extending conduits leading to said nozzle means, said shaft means having passage means connected to said conduits and comprising therewith part of said fluid supply means.

9. The device of claim 1 wherein said wiping, compressing, and filter-cake-discharging means comprises a spiral-helical blade with a conduit along its radially outer edge connected to said nozzle means, said shaft means having a passage therein connected to said conduit.

10. The device of claim 1 wherein said shell comprises a series of metal rings spaced longitudinally from each other.

11. The device of claim 10 wherein said rings are rectangular in cross section and are provided with side walls in one of which is a groove, and spring loaded wire means in said groove, for normally closing the space between adjacent rings but yieldable, said wiping, compressing, and filter-cake-discharging means carrying cleaning blades thereon that extend into said spaces.

12. The device of claim 1 wherein said shell comprises a spiral-helical wire with its successive loops spaced apart.

13. The device of claim 1 wherein said shell comprises a perforated metal sheet.

14. The device of claim 1 having ports in said shaft means, said shaft means being hollow and forming part of said fluid supply means, whereby fluid issues from said ports as well as from said nozzle means.

15. The device of claim 1 having vacuum means connected to said filtrate collection means.

16. A device for dewatering sludge, including in combination:

a filter-dewatering shell having an initial portion, a succeeding portion, and a terminal portion, each comprising a series of longitudinally and closely spaced-apart generally circular loops that present a smooth inner surface interrupted only by the space between successive loops, support means aligning and retaining all said loops in place, filtrate collection means outside said shell and spaced therefrom for collecting filtrate, central shaft means along the axis of said filter-dewatering shell, the distance from said shaft means to said shell being constant in said initial and terminal portions, the distance being shorter in said terminal portion than in said initial portion, the distance between said shaft means and said shell varying in said intermediate portion between the distance in said initial portion to that of said terminal portion, wiping, compressing, and filter-cake-discharging means secured to said shaft means in said initial, succeeding, and terminal portions, and wiping the inner surfaces of said loops, power means for rotating said shaft means, nozzle means on said wiping, compressing, and filter-cake-discharging means facing spaces between said loops, and fluid supply means for supplying said nozzle means with fluid for cleaning out said spaces between loops.

17. The device of claim 16 wherein said shaft means includes passage means that is part of said fluid supply means and ports for venting fluid directly from said shaft means in addition to said nozzle means.

18. The device of claim 16 wherein said loops comprise a series of metal rings.

19. The device of claim 16 wherein said loops comprise helically wound wire.

20. The device of claim 16 wherein said wiping, compressing, and filter-cake-discharging means comprise a spiral-helical blade provided with interior generally radially extending conduits leading to said nozzle means, said shaft means including a main conduit connected to said radially extending conduits, all said conduits comprising part of said fluid supply means.

21. The device of claim 16 wherein said wiping, compressing, and filter-cake-discharging means comprise a spiral-helical blade with a radially outer edge, a conduit running along said outer edge and connected to said nozzle means, conduit means connecting said conduit to said shaft means, said shaft means having a passage for fluid connected to said conduit means and forming therewith and with said conduit part of said fluid supply means.

22. The device of claim 16 wherein said wiping, compressing, and filter-cake-discharging means comprise a spiral-helical blade having a coil-spring wiping means positioned along a radially outer edge thereof.

23. The device of claim 16 wherein said filtrate collection means comprises separate compartments for each of said initial, intermediate, and terminal portions, vacuum means, and separate valve means connecting each said compartment to said vacuum means.

24. The device of claim 16 wherein said initial and terminal portions are cylindrical, said terminal portion being smaller in diameter than said initial portion, said intermediate portion being frustoconical to connect said initial and terminal portions, said shaft means being cylindrical.

25. The device of claim 24 having a removable spiral wrap member for changing the diameter of said shaft means.

26. The device of claim 16 wherein said shell is cylindrical throughout and said shaft means is cylindrical in said initial and terminal portions, being much larger in diameter in said terminal portion than in said initial portion, said intermediate portion being frustoconical to join said initial and terminal portions.

27. The device of claim 16 having vacuum means connected to said filtrate collection means.

28. A device for dewatering sludge, including in combination:

a filter-dewatering shell having an initial portion, a succeeding portion and a terminal portion, each comprising a series of longitudinally and closely spaced-apart generally circular loops that present a smooth inner surface interrupted only by the space between successive loops, support means aligning and retaining all said loops in place, filtrate collection means outside said shell and spaced therefrom for collecting filtrate, central shaft means along the axis of said filter-dewatering shell, the distance from said shaft means to said shell being greatest and being constant in said initial portion and diminishing in said succeeding portion to a smaller constant distance in said terminal portion, conveying and wiping means secured to said shaft means in said initial and succeeding portions, and wiping the inner surfaces of both said initial and succeeding portions, power means for rotating said shaft means, nozzle means on said conveying and wiping means facing the spaces between said loops, and fluid supply means for supplying said nozzle means with fluid for cleaning out said spaces between loops.

29. The device of claim 28 having said conveying and wiping means only in said initial and succeeding portions.

30. The device of claim 28 having conveying means in said terminal portion spaced away from said inner surface.

31. The device of claim 28 having vacuum means connected to said filtrate collection means.

32. The device of claim 28 wherein said conveying and wiping means includes spiral-helical blade means having a radially outer edge and coil-spring blade means supported by said spiral-helical blade means adjacent said outer edge.

33. A device for dewatering sludge, including in combination:

a filter-dewatering shell having an initial portion, a succeeding portion and a terminal portion, each comprising means for exit of fluid and retention of solid particles, filtrate collection means outside said shell and spaced therefrom, for collecting filtrate, a main shaft along the axis of said filter-dewatering shell in said initial and succeeding portions and having a reduced-diameter portion in said terminal portion in said terminal portion, a secondary shaft rotatably mounted on said reduced-diameter portion of said main shaft in said terminal portion, a main sludge compression blade secured to said main shaft in said initial and succeeding portions, said blade providing means for wiping the inner surfaces thereof, a filter-cake-discharging blade secured in said terminal portions to said secondary shaft, power means for rotating said shafts at different speeds relative to each other, nozzle means on said main blade, and fluid supply means for supplying said nozzle means with fluid for cleaning out said means for exit.

34. The device of claim 33 having in addition second nozzle means on said filter-cake-discharging blade, and second fluid supply means for supplying said second nozzle means with fluid.

35. A device for dewater sludge, including in combination:

a filter-dewatering shell having an initial portion, a succeeding portion and a terminal portion, each comprising means for exit of fluid and retenrion of solid particles, filtrate collection means outside said shell and spaced therefrom, for collecting filtrate, a main shaft along the axis of said filter-dewatering shell in said initial portion having a reduced-diameter portion in said succeeding portion and said terminal portion, a secondary shaft rotatably mounted on said reduced-diameter portion of said main shaft in said succeeding and terminal portions, a main sludge compression blade secured to saiid main shaft in said initial portion, and having means for wiping the inner surfaces thereof, sludge compession and filter-cake-discharging blade secured in said succeeding and terminal portions to said secondary shaft, power means for rotating said shafts at different speeds relative to each other, nozzle means on said main wiping blade, and fluid supply means for supplying said nozzle means with fluid for cleaning out said means for exit.

36. The device of claim 35 having second nozzle means on said sludge compression and filter-cake-discharging blade, and second fluid supply means for supplying said second nozzle means with fluid.

37. A device for dewatering sludge, including in combination:

a filter-dewatering shell having an initial portion, a succeeding portion, and a terminal portion, each comprising a perforate housing having an interior surface and a screen supported on said interior surface and itself having an inner surface, filtrate collection means outside said shell and spaced therefrom for collecting filtrate, central shaft means along the axis of said filter-dewatering shell, the distance from said shaft to said shell being constant in said initial and terminal portions, the distance being shorter in said terminal portion than in said initial portion, the distance between said shaft and said shell varying in said intermediate portion between the distance in said initial portion to that of said terminal portion, wiping, compressing, and filter-cake-discharging means secured to said shaft means in said initial, succeeding, and terminal portions, and wiping the inner surfaces of said screen, power means for rotating said shaft means, nozzle means on said wiping, compressing, and filter-cake-discharging means facing said screen, and fluid supply means for supplying said nozzle means with fluid for cleaning out the screen.

38. The device of claim 37 wherein said wiping, compressing, and filter-cake-discharging means comprises a spiral-helical blade provided with a coil-spring wiping blade positioned along a radially outer edge of said spiral-helical blade.

39. The device of claim 38 wherein said spiral-helical blade has interior generally radially extending conduits leading to said nozzle means, said shaft means including a main conduit connected to said radially extending conduits, all said conduits comprising part of said fluid supply means.

40. The device of claim 37 having vacuum means connected to said filtrate collection means.

41. A device for dewatering sludge, including in combination:

a filter-dewatering cylindrical shell comprising a series of longitudinally and closely spaced-apart generally circular loops that present a smooth inner surface interrupted only by the space between successive loops, support means aligning and retaining all said loops in place, filtrate collection means outside said shell and spaced therefrom for collecting filtrate, a central shaft along the axis of said filter-dewatering shell and having an initial portion, a succeeding portion, and a terminal portion, said shaft being cylindrical in said initial portion and frustoconical in said intermediate portion, enlarging to a maximum diameter in said terminanl portion, wiping, compressing, and filter-cake-discharging means secured to said shaft in at least said initial and succeeding portions, and wiping the inner surfaces of said loops, power means for rotating said shaft, nozzle means on said wiping, compressing, and filter-cake-discharging means facing the spaces between said loops, and fluid supply means for supplying said nozzle means with fluid for cleaning out said spaces between loops.

42. The device of claim 41 wherein said loops comprise a series of metal rings.

43. The device of claim 41 wherein said wiping, compressing, and filter-cake-discharging means comprises a spiral-helical blade with a radially outer edge and a coil-spring blade secured to said spiral-helical blade at one end and positioned along said outer edge.

44. The device of claim 41 wherein said loops comprise helically wound wire.

45. The device of claim 41 wherein said wiping, compressing, and filter-cake-discharge means comprises a spiral-helical blade provided with interior generally radially extending conduits leading to said nozzle means, said shaft including a main conduit connected to said radially extending conduits, all said conduits comprising part of said fluid supply means.

46. The device of claim 41 having vacuum means connected to said filtrate collection means.

47. A device for dewatering sludge, including in combination:

a filter-dewatering shell having an initial portion, a succeeding portion and a terminal portion, each comprising a series of longitudinally and closely spaced-apart generally circular loops that present a smooth inner surface interrupted only by the space between successive loops, said loops being metal with radial side walls, one of which has a groove therearound, spring loaded wire means seated in said groove and yieldingly extending into said space between successive loops, support means aligning and retaining all said loops in place, filtrate collection means outside said shell and spaced therefrom for collecting filtrate, vacuum means outside said shell connected to said filtrate collection means, central shaft means along the axis of said filter-dewatering shell, the distance from said shaft means to said shell being greatest and being constant in said initial portion and diminishing in said succeeding portion to a smaller constant distance in said terminal portion, wiping, compressing, and filter-cake-discharging means secured to said shaft means and wiping the inner surfaces of at least said initial and succeeding portions, power means for rotating said shaft means, cleaning blades mounted on said wiping, compressing, and filter-cake-discharging means and extending into the spaces between loops and forcing said spring loaded wire means to yield during rotation of said shaft means, nozzle means on said wiping, compressing, and filter-cake-discharging means facing the spaces between said loops, and fluid supply means for supplying said nozzle means with fluid for cleaning out said spaces between loops.

48. The device of claim 47 wherein said wiping, compressing, and filter-cake-discharging means comprises a spiral-helical blade having a radially outer edge and a coilspring wiping blade positioned along said radially outer edge.

* * * * *